United States Patent [19]

Ishida et al.

[11] Patent Number: 4,754,737

[45] Date of Patent: Jul. 5, 1988

[54] FUEL INJECTION PUMP DEVICE AND METHOD FOR SETTLING THE SAME

[75] Inventors: Akio Ishida, Kanagawa; Hiroshi Oikawa, Tokyo; Kazuo Itoh, Saitama; Kimio Uehara, Tokyo, all of Japan

[73] Assignee: Mitsubishi Jidosha Kogyo Kabushiki Kaisha, Tokyo, Japan

[21] Appl. No.: 823,482

[22] PCT Filed: Mar. 29, 1985

[86] PCT No.: PCT/JP85/00153

§ 371 Date: Jan. 8, 1985

§ 102(e) Date: Jan. 8, 1985

[87] PCT Pub. No.: WO85/05152

PCT Pub. Date: Nov. 21, 1985

[30] Foreign Application Priority Data

| | | | |
|---|---|---|---|
| May 8, 1984 | [JP] | Japan | 59-66995[U] |
| May 14, 1984 | [JP] | Japan | 59-96240 |
| Oct. 1, 1984 | [JP] | Japan | 59-148821[U] |
| Oct. 1, 1984 | [JP] | Japan | 59-148824[U] |
| Oct. 4, 1984 | [JP] | Japan | 59-208569 |
| Mar. 25, 1985 | [JP] | Japan | 60-60225 |

[51] Int. Cl.[4] ..... F02M 39/00

[52] U.S. Cl. ..... 123/500; 123/501; 123/357

[58] Field of Search ..... 123/500, 501, 502, 357, 123/358, 359, 449

[56] References Cited

U.S. PATENT DOCUMENTS

| | | | |
|---|---|---|---|
| 3,999,529 | 12/1976 | Davis | 123/500 |

FOREIGN PATENT DOCUMENTS

| | | | |
|---|---|---|---|
| 52-42269 | 9/1977 | Japan | 123/500 |
| 164773 | 12/1980 | Japan | 123/500 |
| 152456 | 3/1981 | Japan | 123/500 |
| 167770 | 9/1983 | Japan | 123/500 |
| 59-52175 | 4/1984 | Japan | 123/500 |

*Primary Examiner*—Carl Stuart Miller

*Attorney, Agent, or Firm*—Oldham, Oldham & Weber Co.

[57] ABSTRACT

A fuel injection pump device comprising a plunger (8) facing a pressurizing chamber (20) and actuated by a cam (12), a control sleeve (14) mounted on the plunger (8) in a fuel chamber (15), an inclined groove (**8*d*) and longitudinal groove (8*c*) provided on one of the plunger (8) or the control sleeve (14) for controlling the communication of the pressurizing chamber (20) and the fuel chamber (15) by way of an oil passage (8*a*) formed in the plunger (8), and control ports (14*a*) provided on the other of the plunger (8) or the control sleeve (14), which cooperates with both of the grooves (8*c*) and (8*d*). The effective stroke of the plunger (8) can be controlled by turning the plunger (8) around its axis to change the relative position of the inclined groove (8*d*) and longitudinal groove (8*c*) and the control ports (14*a*), and the prestroke thereof, this is a fuel injection timing, can be easily controlled only by moving the control sleeve (14**) in the direction of the plunger axis. Thus, a centrifugal auto-timer becomes useless.

18 Claims, 37 Drawing Sheets

FIG. 18

| type | bore (mm) x stroke (mm) in engine | plunger diameter (mm) | cam lift (mm) | prestroke (mm) | average oil feed ratio ($mm^3$/deg) |
|---|---|---|---|---|---|
| A | 92 x 94 | 9 | 9 | 3.6 | 19.3 |
| B | 110 x 115 | 9.5 | 8 | 3.3 | 18.6 |
| C | 113 x 115 | 9.5 | 9 | 3.6 | 21.5 |
| D | 130 x 140 | 10 | 11 | 4.8 | 25.8 |
| E | 135 x 140 | 11 | 11 | 4.8 | 31.9 |
| F | 135 x 140 | 12 | 11 | 5.1 | 37.8 |
| G | | 12 | 12 | | 41.6 |
| H | | 13 | 12 | | 48.4 |
| I | 100 x 105 | 9 | 9 | 3.6 | 19.3 |
| J | 130 x 140 | 10 | 11 | 5.1 | 37.8 |

| point | plunger diameter D | cam lift h | average oil feed ratio Vp |
|---|---|---|---|
| P | 12 | 14 | 49.8 |
| Q | 12 | 15 | 55 |
| R | 12 | 12.5 | 45 |
| S | 9.5 | 12 | 26.5 |
| T | 9.5 | 11 | 24.5 |
| U | 9.5 | 9.6 | 21.5 |

FUEL INJECTION PUMP DEVICE AND METHOD FOR SETTLING THE SAME

TECHNICAL FIELD

The present invention relates to a fuel injection pump device for injecting fuel into the combustion chamber of an internal combustion engine.

BACKGROUND ART

A fuel injection pump device for pumping fuel into the fuel injection nozzle of a Diesel engine has been hitherto composed so that the control of a fuel injection quantity is carried out by turning a plunger for pressurizing the fuel in the pump, and composed so that the control of a fuel injection beginning time is carried out by changing the rotating phase of a cam shaft for driving said plunger, which is driven by the engine, with respect to the crank angular phase of the engine by use of a centrifugal auto-timer provided on the cam shaft. In the case where the injection timing is controlled, however, the inertia mass of the cam shaft is relatively larger and the pump driving torque transmitted from the cam shaft to the plunger is large, and such a conventional fuel injection pump device is therefore disadvantageous: a large-sized timer must be used as an inevitable consequence, the cost is accordingly increased and the whole of the pump is made large-scaled.

The conventional pump device shown in FIG. 1 has the following defects. The reference numeral 01 represents a housing, in which a barrel 02 is arranged in its upper part and a cam shaft 04 is arranged in a cam shaft case 03 in its lower part, and the head 06 of a plunger 05 is inserted and slidably arranged in said barrel 02.

A spring shoe 07 is mounted on the center of said plunger 05 and presses down the plunger 05 by virtue of a spring 08 placed between the plunger 05 and the pump housing 01.

Said plunger 05 has an oil port 010 provided therein so as to communicate the head 06 and its lower body portion 09 with each other, and a control sleeve 011 which is turnable and slidable up and down is mounted on the lower body portion 09 and arranged so as to open or shut said oil port 010.

Said control sleeve 011 has an upper lead 012 and an lower lead 013 formed thereon. The sleeve is turned by the movement of an injection quantity control rod 020 in the normal direction to FIG. 1, thereby to control the fuel injection quantity, and the sleeve is slided vertically by way of an eccentric pin 015 by an injection timing control rod 014, thereby to control the fuel injection timing.

In the aforementioned composition in which fuel fed from a fuel source (not shown) such as a feed pump is supplied to a fuel chamber 016 formed in the housing 01 and remains there, however, there is a need of providing a spill-way for the fuel in order to actuate a tappet 017 provided beneath the plunger 05, and a spill port 018 is therefore formed in the said tappet 017, through which spill port 018 a part of the fuel is supplied to the cam shaft case 03.

Said housing 01 is accordingly filled with the fuel and the lubrication of said tappet 017, cam shaft 04 and the likes will be carried out by the fuel itself. Perhaps, seizure is frequently caused to happen because the surface pressure in each lubricating part is too high.

Since the conventional pump device mentioned above is composed so that all of the cam shaft 04, the tappet 017 driven by the cam shaft, the plunger 05 and the spring shoe 07 are sliding in the fuel and the resistance of the fuel becomes therefore larger, it has disadvantages such as a difficult revolution of the engine at a high speed and an excess of heat generated by this resistance.

DISCLOSURE OF INVENTION

It is the main object of this invention to obtain an injection pump having a simple structure with an auto-timer omitted, in which the control of a fuel injection timing can be realized by a small operating force.

In order to achieve this object, the present invention proposes a fuel injection pump device characterized in that a control sleeve is slidably mounted on the outer periphery of a plunger and said control sleeve is moved in the axial direction of the plunger thereby to control the injection timing of fuel.

According to this composition, it is sufficient only to move the control sleeve in said axial direction, with a small force required for this operation, and it is possible to make up the structure of an injection timing control member for actuating the control sleeve simply.

Since the delivery pressure from the fuel injection pump device is furthermore prevented from rising more by moving the control sleeve to advance the injection timing when the engine is in a high speed region, the fuel injection pump is not damaged. In addition, since the fuel injection pump is not damaged even when the engine is in the high speed region, its delivery pressure in the medium and low speed regions of the engine can be increased, the fuel consumption can be lowered and the black smoke in the exhaust gas can be reduced in quantity.

It is another object of the present invention to obtain an injection timing settling method in which the injection timings of a fuel injection pump device for a plurality of cylinders in an engine can be finely regulated quickly, easily and positively so as to be matched one another.

The first invention for achieving this object comprises attaching movably an injection timing control member for moving a control sleeve on a control shaft, then moving the control sleeve to position the control sleeve to a plunger, and fixing the injection timing control member to the control shaft.

The second invention comprises removing a delivery valve from a fuel injection pump device and connecting a pressurized fluid source thereto in place of the delivery valve, moving a control sleeve, and fixing an injection timing control member to a control shaft at the position where the pressure of fluid has been changed.

By the abovementioned composition, it is possible to carry out easily the adjustment of the initial position of the injection timing control member to the control sleeve.

BRIEF DESCRIPTION OF DRAWINGS

FIG. 18 is a table representing the dimensions of the main parts of the fuel injection pumps used for the respective engine mechanisms.

BEST MODE FOR CARRYING OUT THE INVENTION

A number of embodiments according to the present invention will be described in detail with reference to the accompanying drawings.

Figure 7:
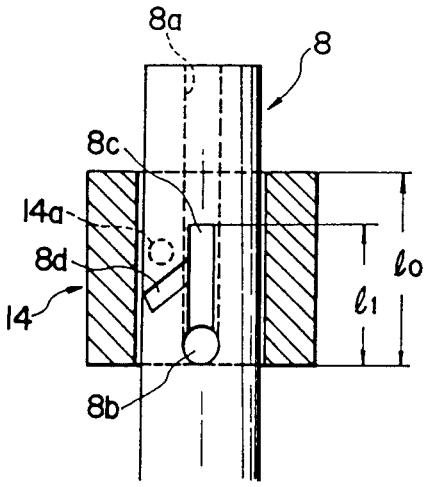
Figure 8:
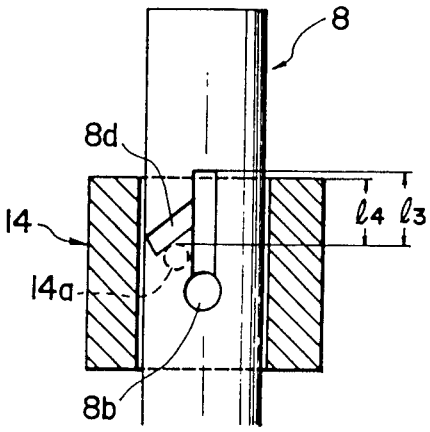
Figure 9:
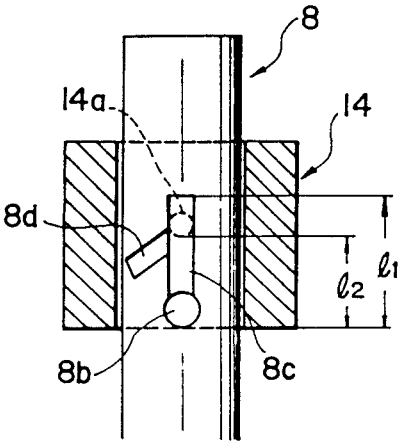
Figure 10:
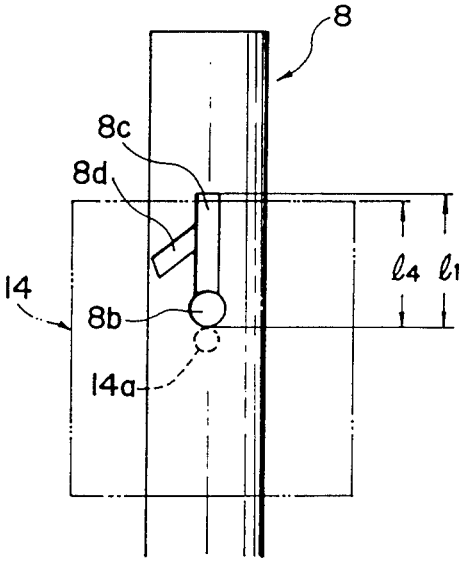

In the first embodiment shown in FIG. 2 to FIG. 25, the reference numeral 2 represents a housing of an in-line fuel injection pump for a Diesel engine, and 4 represents one of a plurality of barrels held in the housing, which barrels 4 are positioned so that their axes stand in rows on one plane in the housing 2. This barrel 4 is composed of a first barrel part 4*a* and a second barrel part 4*b* press-fitted thereon. The reference numeral 6 represents a delivery valve holder fixed on the top of each barrel 4, which holder is to be connected to the respective cylinders of an engine; 7*a* is a delivery valve; 8 is a plunger slidably mounted in each barrel 4; 10 is a spring for biasing the plunger downwards; 12 is a cam interlocked with a driving shaft (now shown) of an engine to push up the plunger 8; 14 is a control sleeve slidably mounted on the outer periphery of the plunger 8; 16 is a guide pin fixed on each barrel 4 and engaged in a guide groove 17 of the control sleeve 14 to restrain its turn; and 18 is a sleeve turnably supported on the barrel 4 but non-turnably engaged with the plunger 8. The plunger 8 has an oil passage 8*a* which communicates its upper end face and its pheripheral side to each other, peripheral side openings 8b formed on the peripheral side in communication with the oil passage 8a, a longitudinal groove 8c cut on the peripheral side so as to continue to the opening 8b and to run along the axis of the plunger 8, and an inclined groove 8d intersecting this longitudinal groove 8c and slanting to the plunger axis, wherein a control groove is formed by both these grooves 8c and 8d and the oil feed ports 8b (which will be hereinafter called "the openings"). In the control sleeve 14, on the other hand, control ports 14a are perforated to define a fuel injection end. The condition which is required to inject fuel when the plunger 8 makes a given effective stroke as shown in FIG. 7 will be stated below. Representing the vertical width or length of the control sleeve 14 by the sign $l_0$ and the length including the longitudinal groove 8c and the opening 8b by the sign $l_1$, namely, it is required that the relation $l_0 > l_1$ is satisfied. Representing the length between the upper edge of the control port 14a and the upper end of the control sleeve 14 by the sign $l_4$ and the length between said upper edge of the control port 14a and the upper end of the longitudinal groove 8c by the sign $l_3$, it is also required, as a condition for preventing the two-stage blasting of fuel at the injection end when the plunger 8 injects the fuel at the minimum effective stroke as shown in FIG. 8, that the relation $l_3 \geqq l_4$ is satisfied. And, it is required as a condition that the plunger 8 is permitted to move up and down at the position where the control port 14a confronts the longitudinal groove 8c as shown in FIG. 9, this is a condition for determining no injection of fuel, that the relation $l_l > l_2$ is satisfied, representing the length between the lower edge of the control port 14a and the lower end of the control sleeve 14 by the sign $l_2$. It is further required that the relation $l_1 \geqq l_4$ is satisfied, as a condition that no injection of fuel can be positively realized even when the control port 14a is blocked up at the lower edge of the opening 8b by the plunger 8, under the state of said no injection operation as shown in FIG. 10. In FIG. 4, the reference numeral 15 represents a fuel chamber for storing fuel fed from a feed pump (not shown), wherein the fuel is not leaked into a cam shaft case 13, because the plunger 8 is inserted in the cylindrical second barrel part 4b, with an oil-tight state held between them. The reference numeral 21 represents an oil feed opening through which lubricating oil is fed to the cam shaft case 13, and 23 represents a guide pin protruded on a tappet 25 and slidably engaged in a guide groove 27 cut on a housing 2. Although not illustrated in FIG. 5, the reference numeral 29 shown in FIG. 4 represents an adjustment screw (not shown in FIG. 5 and FIG. 12) screwed in a screw hole of an operation shaft 26 mentioned below, wherein the fuel injection timing can be finely adjusted by relaxing the screw 29 to rotate a lever 28 properly.

When the cam 12 is rotated one time by a cam shaft 12a driven by the rotating force receiving from the driving shaft of the engine and the roller 25a of the tapper 25 is pressed by the cam 12, according to the abovementioned composition, the plunger 8 will be reciprocated upwards by a given lift or vertically at one stroke.

Figure 11:
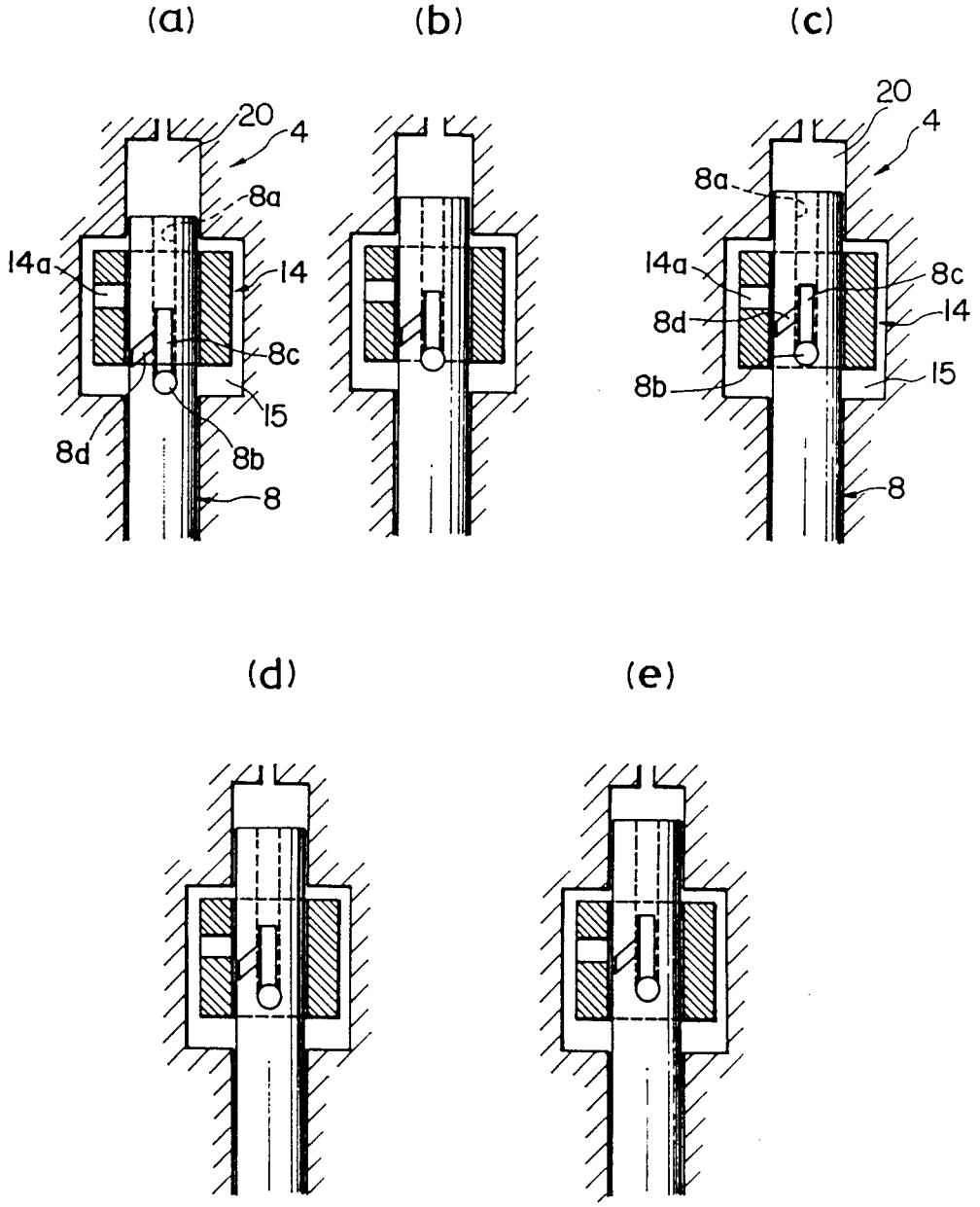
Figure 12:
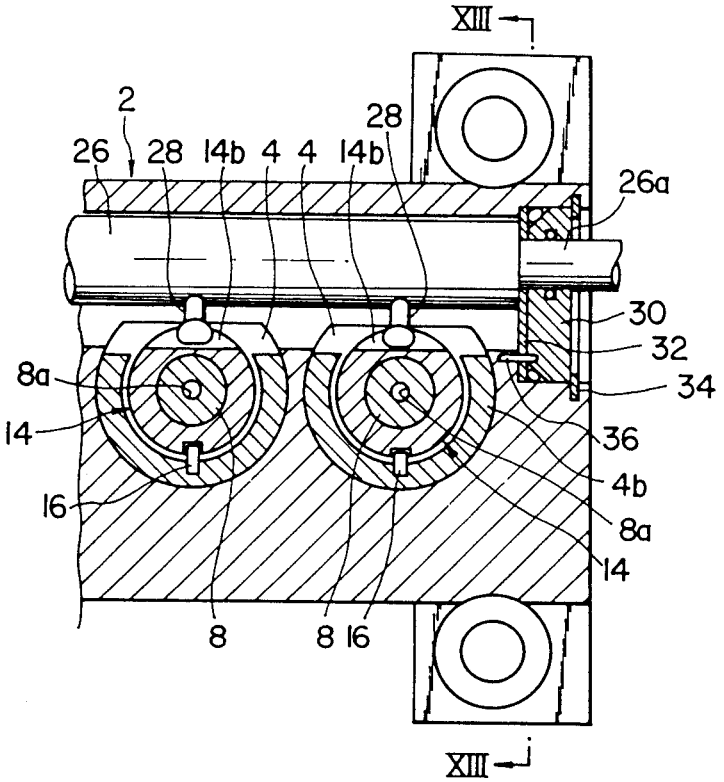
FIG. 12 is a sectional view of FIG. 2 taken along the line XII—XII and seen from the arrows.
Figure 13:
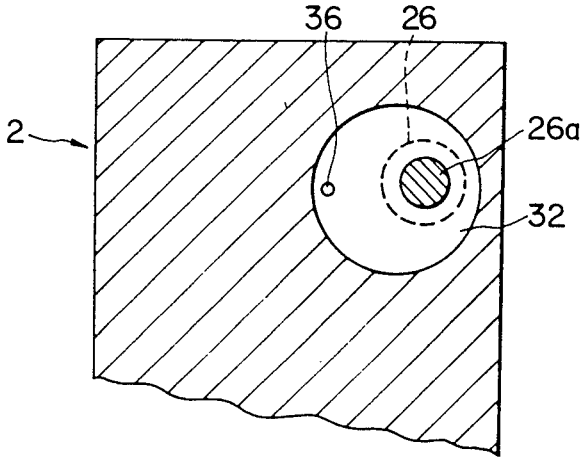
FIG. 13 is a sectional view of FIG. 12 taken along the line XIII—XIII and seen from the arrows.

Now, the course from the state shown in FIG. 4 to the state in that the plunger 8 is pressed by the cam 12 to pump out the fuel will be described here with reference to FIG. 11(*a*) to (*e*) [wherein the control sleeve 14 shall be in a fixed position between the states (a) and (b)]. When the related position of the plunger 8 and the control sleeve 14 is in the state shown in FIG. 11(*a*) or the opening 8b is not still blocked up completely by the control sleeve 14, the fuel is not pumped out because a pressurizing chamber 20 and the fuel chamber 15 are in communication with each other. After the opening 8b is then blocked up by the control sleeve 14 as shown in FIG. 11(*c*) via the state of FIG. 11(*b*), the pressurizing chamber 20 is interrupted from the fuel chamber 15 and pressurized by the plunger 8. This stroke of the plunger 8 which moves between the states (a) and (c) is called a prestroke. When the plunger 8 continues to rise as shown in FIG. 11(*d*) from the state of FIG. 11(*c*), the delivery pressure in the pressurizing chamber 20 overcomes the spring force of a spring 7b in the delivery valve holder 6 and the delivery valve 7a is opened so that high-pressure fuel is fed to an injection nozzle V through an injection tube 6a. Thus, the fuel is being pumped out until the inclined groove 8d of the plunger 8 communicates to the control port 14a as shown in FIG. 11(*e*). When the inclined groove 8d gets to face the control port 14a as shown in FIG. 11(*e*), the pressurizing chamber 20 begins to communicates with the fuel chamber 15 by way of the oil passage 8a, opening 8b and longitudinal groove 8c, and as a result, the pumping of fuel comes to an end. Since the inclined groove 8d extends on the outer periphery of the plunger 8 so as to slant with respect to its axis, as can be seen from FIG. 6, the confrontation time of the inclined groove 8b with the control ports 14a of the control sleeve 14 in the stroke of the plunger 8 can be changed by the turning displacement of the plunger 8 caused by the sleeve 18, whereby the fuel injection quantity in one stroke of the plunger 8 can be regulated. In addition, the displacement of the sleeve 18 in its turning direction is carried out by displacing a rack 24 which engages with a ball 22 secured on the sleeve 18 in its longitudinal direction.

The fuel injection timing control mechanism will be described here. The control of the fuel injection timing is conducted by the sliding displacement of the control sleeve 14 along the plunger 8, and this sliding displacement is carried out by means of an operation shaft 26 supported in the housing 2 so as to lie by the side of the control sleeve 14 and having its axis on one straight line parallel to a plane on which the aforementioned barrels 4 stand in rows and perpendicular to the axis of the plunger 8, a lever 28 fixed on the operation shaft 26 and extended from the operation shaft toward the plunger 8, and a notched groove 14b formed on the outer peripheral surface of the control sleeve 14, which is engaged with the fore end of the lever 28 to interlocked the turning displacement of the level 28 around the operation shaft 26 and the sliding displacement of the control sleeve 14. The outer peripheral surface of the lever 28 at its end has such a curvature that it is always in contact with the inner peripheral surface of the notched groove 14b, without giving any play between them. As well shown in FIG. 12, the support part 26a of the operation shaft 26 at each end is supported on the housing 2 by way of a bearing 30 having an outer diameter which is larger than an external dimension including the operation shaft 26 and lever 28 in the direction of the diameter of the operation shaft 26, with a plate 32 disposed between one end of the bearing 30 and the housing 2. In addition, the reference numeral 34 represents a snap ring which serves to prevent the bearing 30 secured in the housing 2 from slipping out of the housing, and 36 represents a positioning pin embedded in the bearing 30 and running through a plate 32 to engage with the housing 2. The fixing of the operation shaft 26 is conducted by mounting each barrel 4, plunger 8 and control sleeve 14 within the housing 2, and then inserting the operation shaft 26 into the housing 2 from its end.

Figure 1:
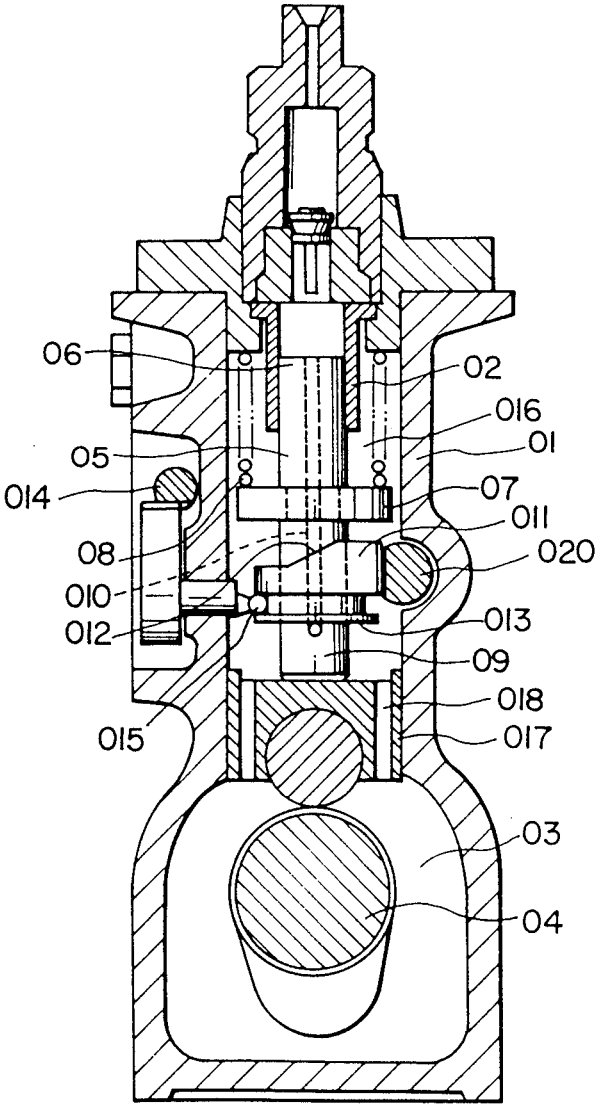
FIG. 1 is a sectional view of a conventional fuel injection pump.
Figure 2:
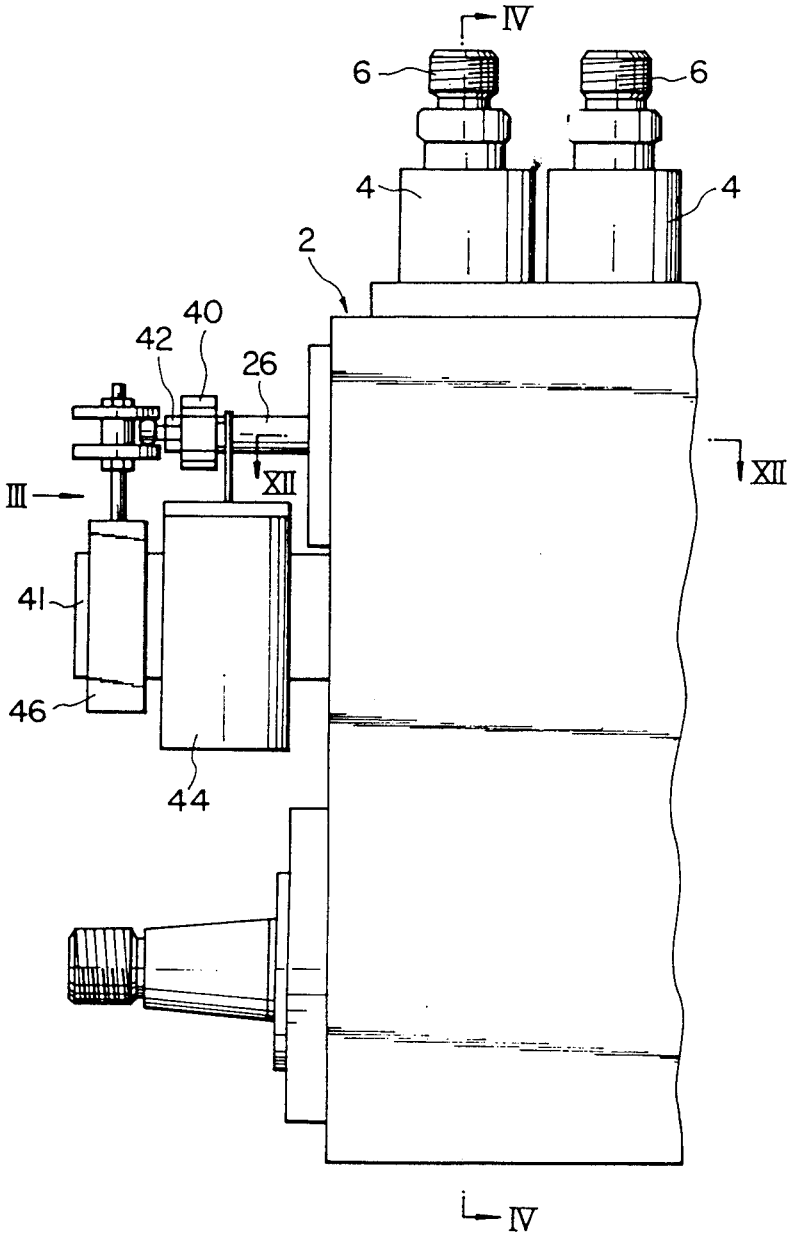
FIG. 2 is a side view showing the first embodiment according to this invention.
Figure 3:
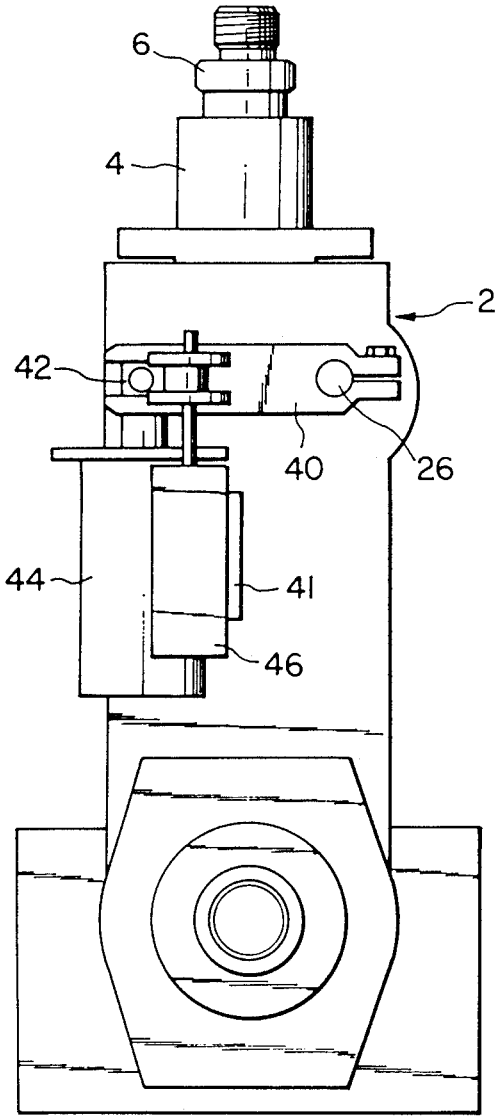
FIG. 3 is a side view of FIG. 2 seen from the arrow III.
Figure 4:
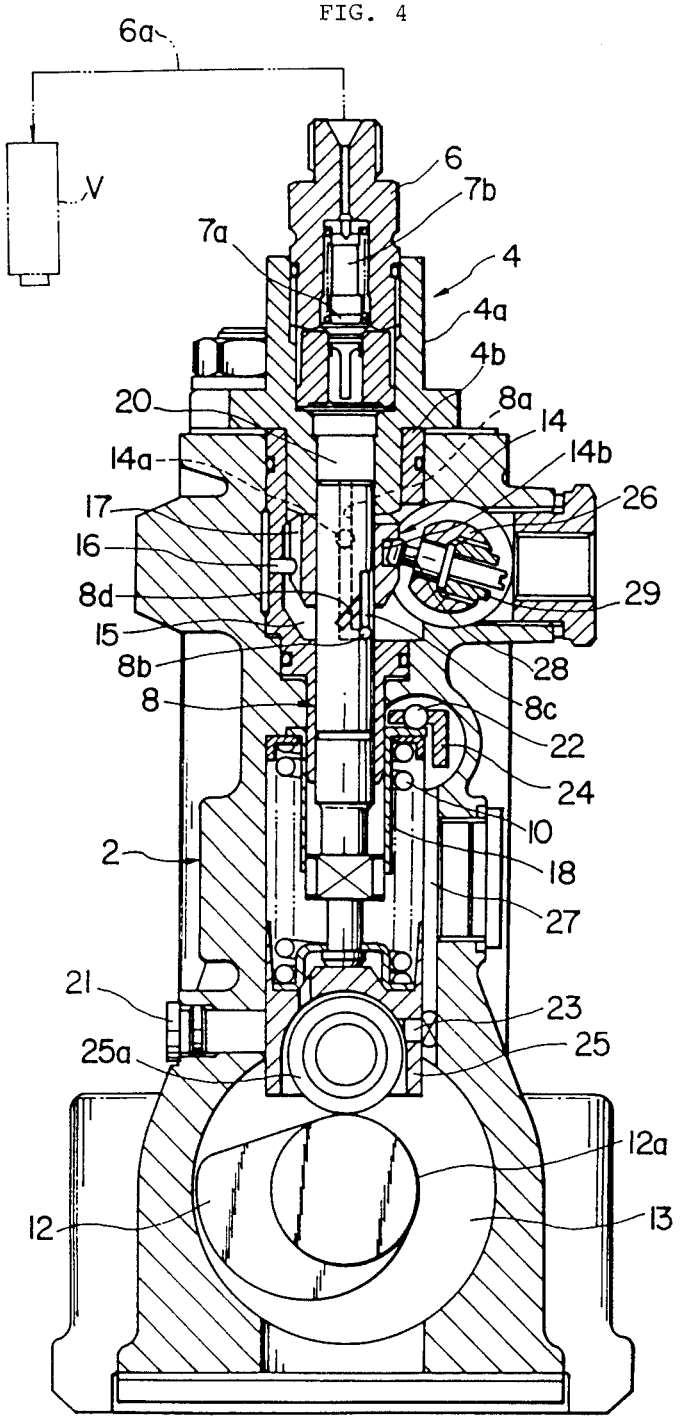
FIG. 4 is a sectional view of FIG. 2 taken along the line IV—IV and seen from the arrows.
Figure 5:
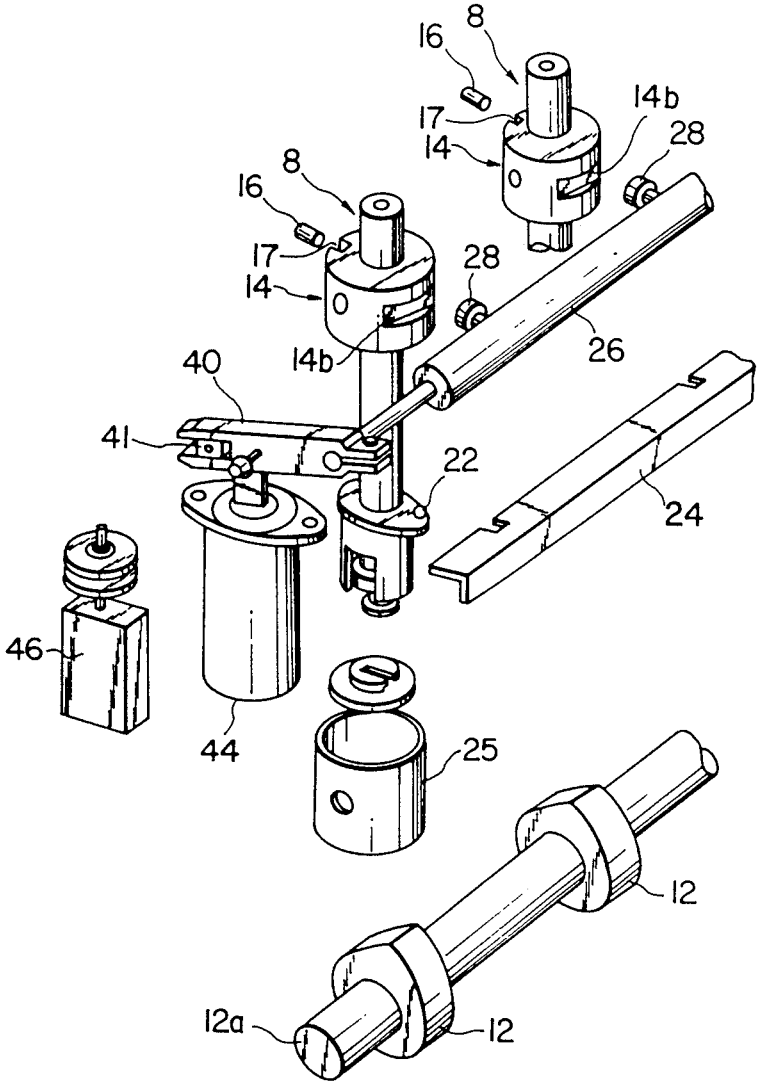
FIG. 5 is an exploded perspective view showing important parts.
Figure 6:
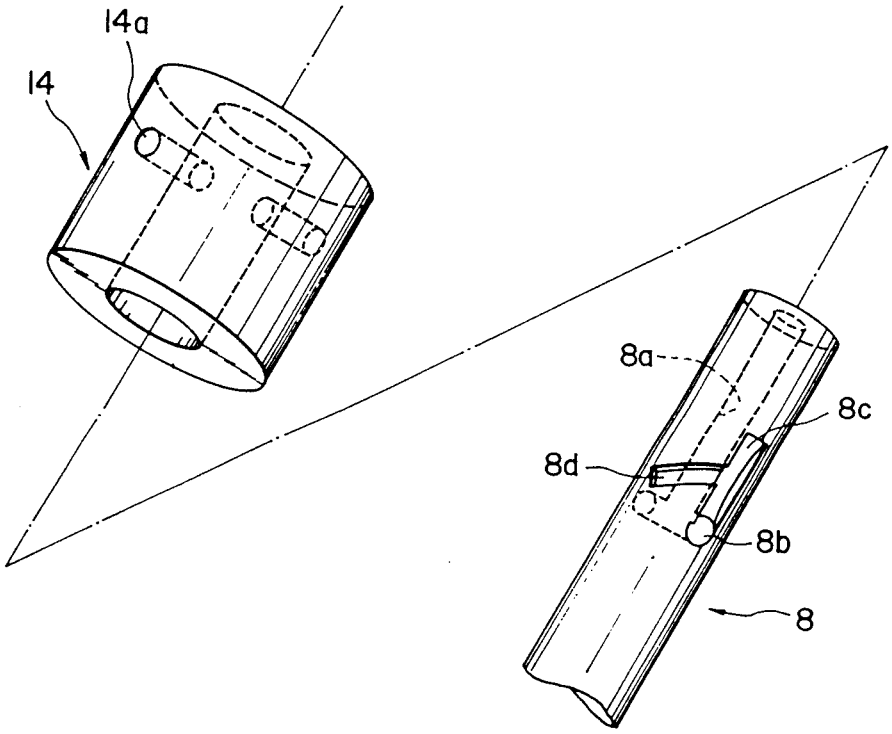
FIG. 6 is an enlarged perspective view of the main parts of a plunger 8 and a control sleeve 14, FIGS. 7 to 10 each are an operation illustrative view showing the operation of the plunger 8 and control sleeve 14 in their relative related position, FIGS. 11(*a*)-11(*e*) are operation illustrative views showing the pumping operation caused by the plunger.
Figure 14:
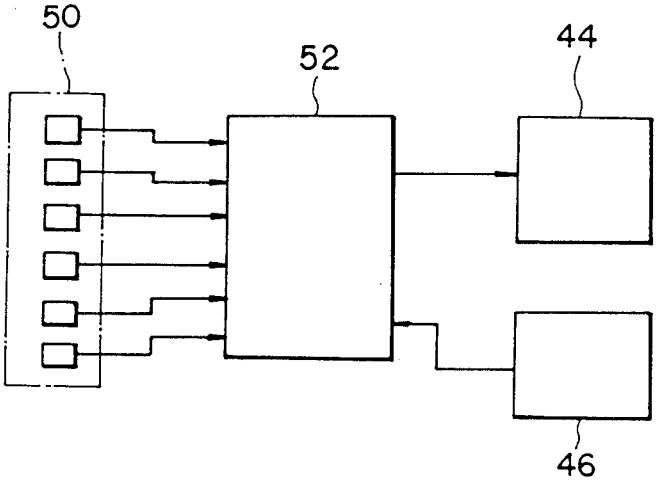
FIG. 14 is a view of the actuating circuit for an electromagnetic solenoid 44, FIGS. 15 to 17 each are a front view showing a modification of a control groove cut on the outer peripheral surface of the plunger.

The turning displacement of the operation shaft 26 is conducted by means of an operation lever 40 fixed on one end of the operation shaft 26 and an electromagnetic solenoid 44 supported on the housing 2 by a bracket 41, which turns the operation lever 40 by way of a slider 42, as shown in FIGS. 2, 3 and 5. In order to operate the electromagnetic solenoid 44 with accuracy, a potentiometer 46 for measuring the turning displacement of the operation lever 40 is further supported on the bracket 41. As shown in FIG. 14, a control unit 52 is composed so that various informations on the operating state of the engine from operating state information sources 50, for example an engine speed, degree of an accelerator pedal trod, temperature of cooling water, temperature of intake air, boost pressure of an air intake system and temperature of exhaust gas, and the information on the turning displacement of the operation shaft 26 from the potentiometer 26 are sent to the control unit and these informations are calculated synthetically, thereby to obtain a control of accurate injection timing. It is possible to adopt a differential transformer type sensor in place of this potentiometer 26. In the aforementioned embodiment, it is also possible to turn the operation lever 40 by a hydraulic cylinder in place of the electromagnetic solenoid 44.

Furthermore, the rack 24 constitutes a fuel injection quantity control member, and the operation shaft 26, operation level 40 and slider 42 constitute a fuel injection timing control member. A fuel injection control means is made up of a governor (the minimum-maximum type or the all-speed type) (not shown) for driving the rack 24, the control unit 52 and the electromagnetic solenoid 44.

Since the first embodiment has the aforementioned composition, it has such operational effects as mentioned below. By turning the plunger 8 around its axis to change the relatively related position of the control port 14*a* to the inclined groove 8*d* forming a part of the control groove, namely, the effective stroke of the plunger is changed whereby the fuel injection quantity can be regulated. By causing the longitudinal groove 8*c* to accord with the control port 14*a*, the state of no fuel injection can be achieved as shown in FIG. 9. And further, the turning displacement of the operation shaft 26 having the lever 28 causes the control sleeve 14 to displace in the direction of the plunger axis. Thus, the prestroke of the plunger is changed, whereby the injection timing can be adjusted. Since the sizes of the respective parts between the plunger and control sleeve are set so that the relations $l_0 > l_1$[the expression (1)], $l_1 > l_2$[the expression (2)], $l_1 \geqq l_4$ [the expression (3)] and $l_3 \geqq l_4$[the expression (4)] may be satisfied, as have been illustrated in FIGS. 7 to 10, the following conditions will be defined respectively: (a) the condition of enabling the injection of fuel in accordance with the expression (1); (b) the condition of ensuring no injection of fuel in accordance with the expression (2); (c) the condition of obstructing positively the fuel injection under the operating state of no injection in accordance with the expression (3); and (d) the condition of obstructing positively the two-stage blasting of fuel by causing the upper end of the longitudinal groove 8*c* to face into the fuel chamber 15 from the upper end of the control sleeve 14, even if the control port 14*a* is not in communication with the control groove when the plunger 8 is displaced up to the top dead center as shown in FIG. 9, in the case that the fuel is being injected at the minimum effective stroke of the plunger, in accordance with the expression (*4*). Therefore, accurate controls of the fuel injection quantity and injection timing can be realized, and the injection timing control can be effected in an electronic control mode because the injection timing is controllable by a small operating force. Because of no requirement of such a timer as used in a conventional device, it is possible to simplify the structure of this fuel injection pump device correspondingly. Furthermore, since the first embodiment has such a structure that the plunger 8 is oil-tightly inserted in the lower cylindrical portion of the second barrel part 4*b*, it is possible to avoid the flowing of the fuel in the fuel chamber 15 into the cam shaft case 13. In the use of a pump having such a structure that its discharge pressure or pump pressure is increased by modifying the profile of the cam 12 to make the cam lift larger, while keeping the diameter of the plunger shown in FIG. 4, or enlarging only the plunger diameter, with the cam lift kept as it is, it is easily enabled to use the pump under a pressure lower than its withstanding pressure, if an advancing operation (by the downward movement of the control sleeve 14) is carried out through the aforementioned injection timing control, when the pump pressure reaches near to the withstanding pressure of the pump, this is when the engine is in a high speed region. And, it is thereby possible to make larger the discharge pressure of the pump in the medium and low load regions of the engine, with obtaining various operational effects, for example of seeking the increase in the output power of the engine in the same regions.

Figure 15:
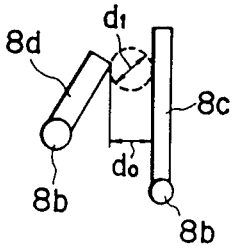
Figure 16:
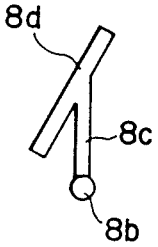
Figure 17:
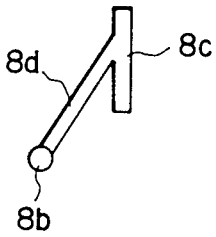

Although the injection quantity control has been conducted by turning the plunger 8, in the aforementioned first embodiment, it may be composed so that the control sleeve is not only moved up and down by one operating link system, but also turned around the plunger axis. The control groove has been provided in the plunger 8 and the control ports 14*a* in the control sleeve 14, but the control groove may be provided on the side of the control sleeve and the control ports on the side of the plunger, respectively. In addition, the control groove has been cut only on the peripheral surface of the plunger 8 at one side, but it may be further provided on the peripheral surface thereof at the other side. In the first embodiment, two openings 8*b* running through the plunger and two control ports 14*a* of the control sleeve have been provided, but one opening and one control port may be provided at the positions where they confront with each other. As shown in FIG. 15, a modification of the control groove in the aforementioned embodiment may be a control groove comprising openings 8*b* communicating with a longitudinal groove 8*c*, an inclined groove 8*d* and the oil passage 8*a* in the plunger. In this case, the inner diameter $d_1$ of the control port is set to be at least equal to or larger than the distance $d_0$ between both the grooves 8*c* and 8*d*, in order to ensure a state of no fuel injection. The control groove may be further formed as shown in FIG. 16 and FIG. 17. In the aforementioned first embodiment, furthermore, there may be provided a notch along both the inner and outer peripheral surfaces of the upper end of the control sleeve 14 or a notch on the lower end of the first barrel part 4*a*, wherein even when the control sleeve gets into contact with the lower end of the first barrel part 4*a*, with an oil-tight state formed between them, fuel will be discharged into the fuel chamber through said notch, with an operational effect of preventing the two-stage blasting of fuel.

Figure 22:
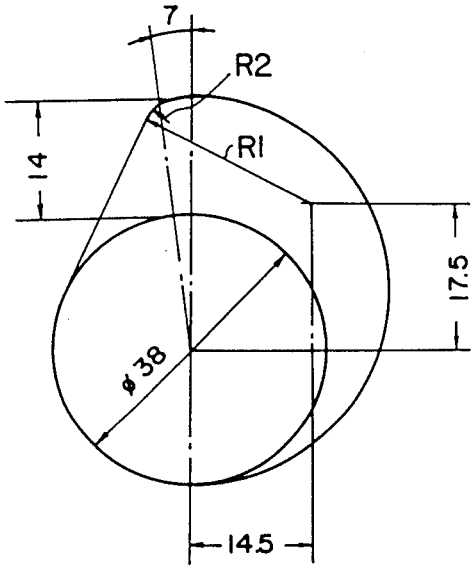
FIG. 22 is a view of a cam profile.
Figure 23:
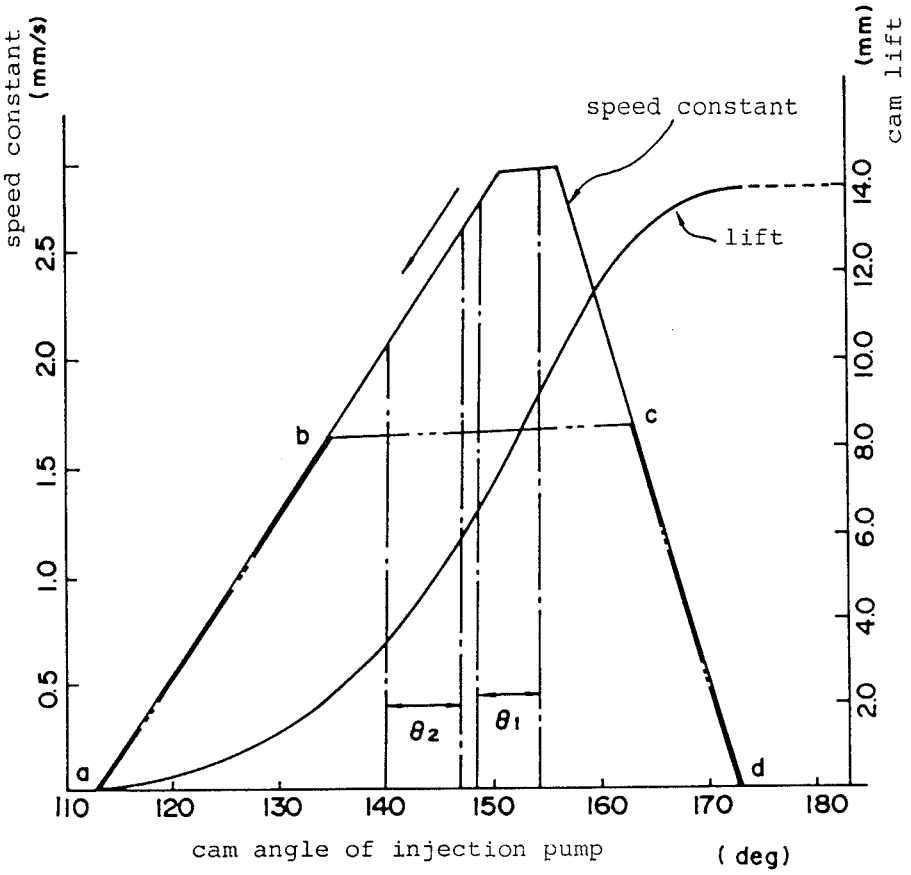
FIG. 23 is a cam diagram.

Referring to an injection pump having such a composition that the diameter of the plunger 8 is 12 mm and the lift of the cam 12 (which has a cam profile shown in FIG. 22) is 14 mm, as shown at the point P in FIG. 20, and the cam diagram shown in FIG. 23 is obtained, by way of example, the operational effect thereof will be described.

Figure 21:
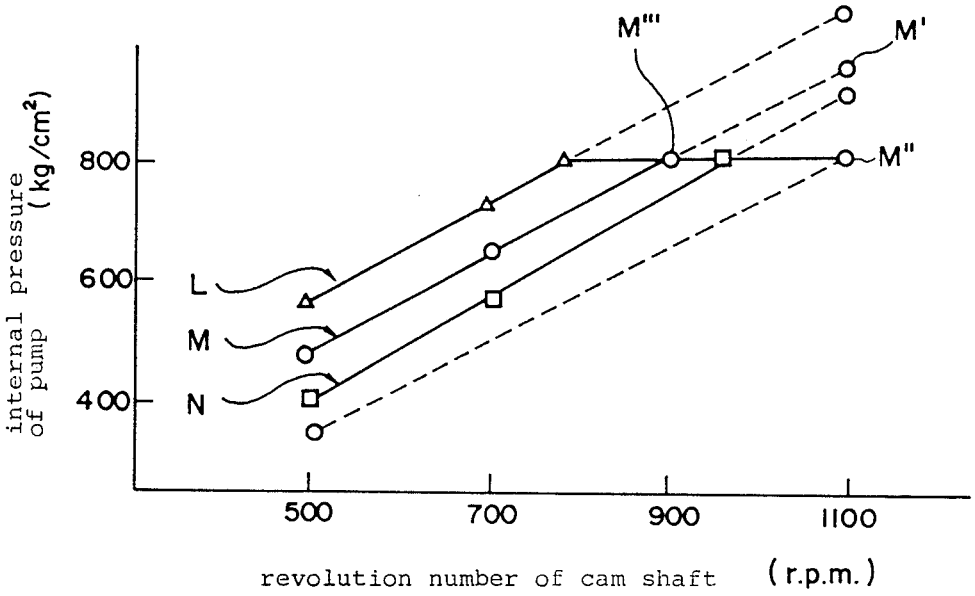
FIG. 21 is a graph showing the relation between the revolution number of a cam shaft and the internal pressure on the pump side.

As shown in FIG. 21, the relation between the revolution number of the cam shaft and the delivery pressure of the pump is represented by the graph M. Assuming that the limit of the withstanding pressure in use of the pump is 800 kg/cm$^2$ at that time, the delivery pressure for fuel is increased by the plunger 8 with the increase in the engine speed, when the cam angle shown in the cam diagram of FIG. 23 falls within the range $\theta_1$ in the so-called medium and low engine speed regions wherein the revolution number of the cam shaft varies from 500 to about 900 r.p.m. When the revolution number of the cam shaft becomes about 900 r.p.m., the delivery pressure reaches the withstanding pressure in use of the pump. At about 900 r.p.m., or when the revolution number of the cam shaft reaches the point M‴, the control sleeve 14 is moved downward by a given distance along the plunger 8. Thus, the prestroke of the plunger 8 becomes short and as a result, fuel is injected with the speed constant directed in the direction of the arrow, or the cam angle falling within the range $\theta_2$, as shown in FIG. 23. In the high speed region of the engine, therefore, fuel is supplied from the fuel injection pump to the engine at the constant and maximum delivery pressure M″ regardless of the engine speed, as shown in FIG. 21. And at the same time, the injection timing is controlled so as to be advanced, whereby the fuel is injected into a combustion chamber at a proper time and mixed with air in said chamber for combustion.

The dimensions of the main parts of fuel injection pumps which have been already known in the market and used in various types of Diesel engines (injection pumps having such a structure that the injection timing is adjusted by a centrifugal auto-timer), are tabulated as shown in FIG. 18. Plotting the average oil feed ratios (mm$^3$/deg) on the abscissa and the values of (plunger diameter)$^2\times$cam lift on the ordinate as to the types A to J from the table of FIG. 18, there is obtained the graph shown in FIG. 19. From the graph of FIG. 19, it will be seen that the related expression, $V_p=2.47\times10^{-2}\times D^2\times h$, is satisfied between the geometrical average oil feed ratios $V_p$ (mm$^3$/deg) and the plunger diameter D (mm) and the cam lift h (mm). This related expression means that the average oil. feed ratio can be approximately calculated from the plunger diameter and cam lift.

Figure 19:
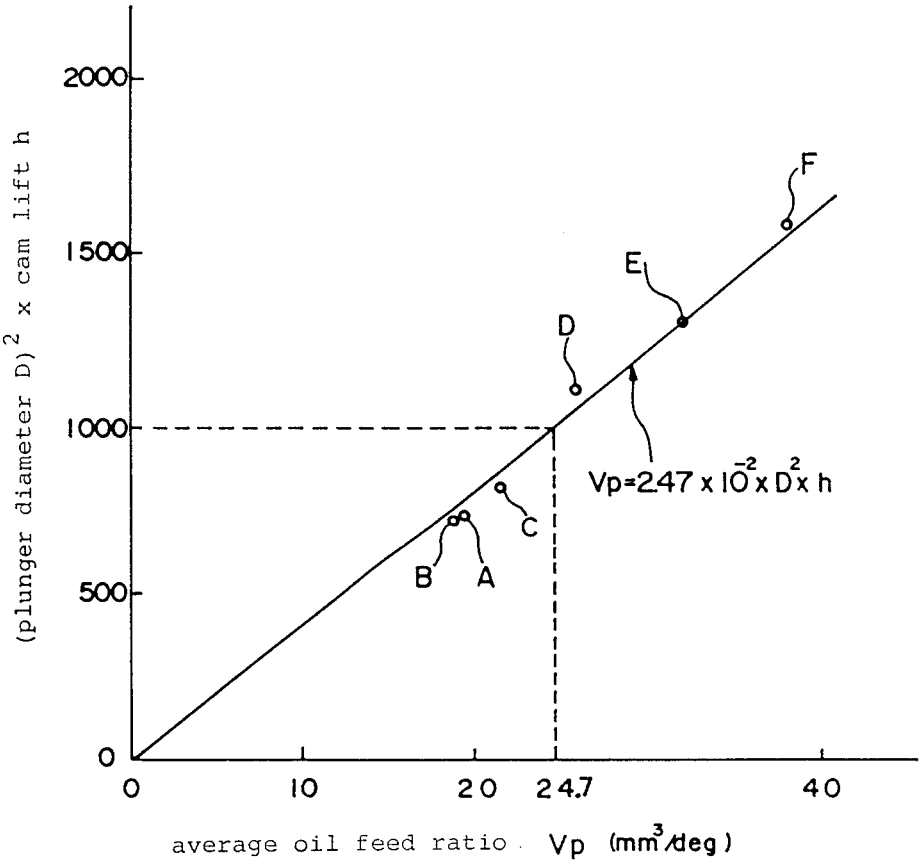
FIG. 19 is a graph showing the relation between the average oil feed ratio and (plunger diameter D)$^2\times$cam lift h.

As for the types A to J, by the way, the relation between the piston displacement $V_s$ (l) per one engine cylinder and the geometrical average oil feed ratio $V_p$ will be next discussed. These relations will be represented as shown in the graph of FIG. 19, from which it can be seen that the respective injection pumps are contained in the lower region under the straight line K. In other words, it will be said that any injection pump having such a structure that the average oil feed ratio or the delivery pressure is heightened to increase the fuel injection quantity per the unit angle of its cam does not exist in the upper region over the straight line K. This reason has some connection with the use of a centrifugal auto-timer for conducting the control of the injection timing in the conventional pumps of the types A to J. Namely, the reason is that each injection pump of the types A to J is set, as shown by the single-dotted chain line in the graph of FIG. 21, so that the delivery pressure of the pump reaches a state almost near to the limit of the withstanding pressure of the pump itself, when an engine is being operated in the maximum speed region, and the injection timing control is conducted by changing the rotating phase of the cam shaft with respect to the crank angular phase of the engine gradually, when the engine is in the medium speed region. Accordingly, such conventional injection pumps could not be used in such a way that in the medium and low speed regions of the engine (corresponding to the revolution number of the cam shaft of 500–900 r.p.m.), the delivery pressure is heightened to be in the region shown by the straight lines L, M and N, thereby to increase the output performance of the engine.

When the injection timing control is conducted in the fuel injection pump according to the present embodiment, by the way, fuel is injected in the range of the cam angle $\theta_2$, as clarified from FIG. 23. At that time, the cam lift is lower than that in the range of the cam angle $\theta_1$ which is in an ordinary injection timing. Therefore, it is possible to prevent the pump delivery pressure from lowering or rising when the injection timing is advanced.

The relation of this injection timing control and the pump delivery pressure will be described in detail.

Figure 20:
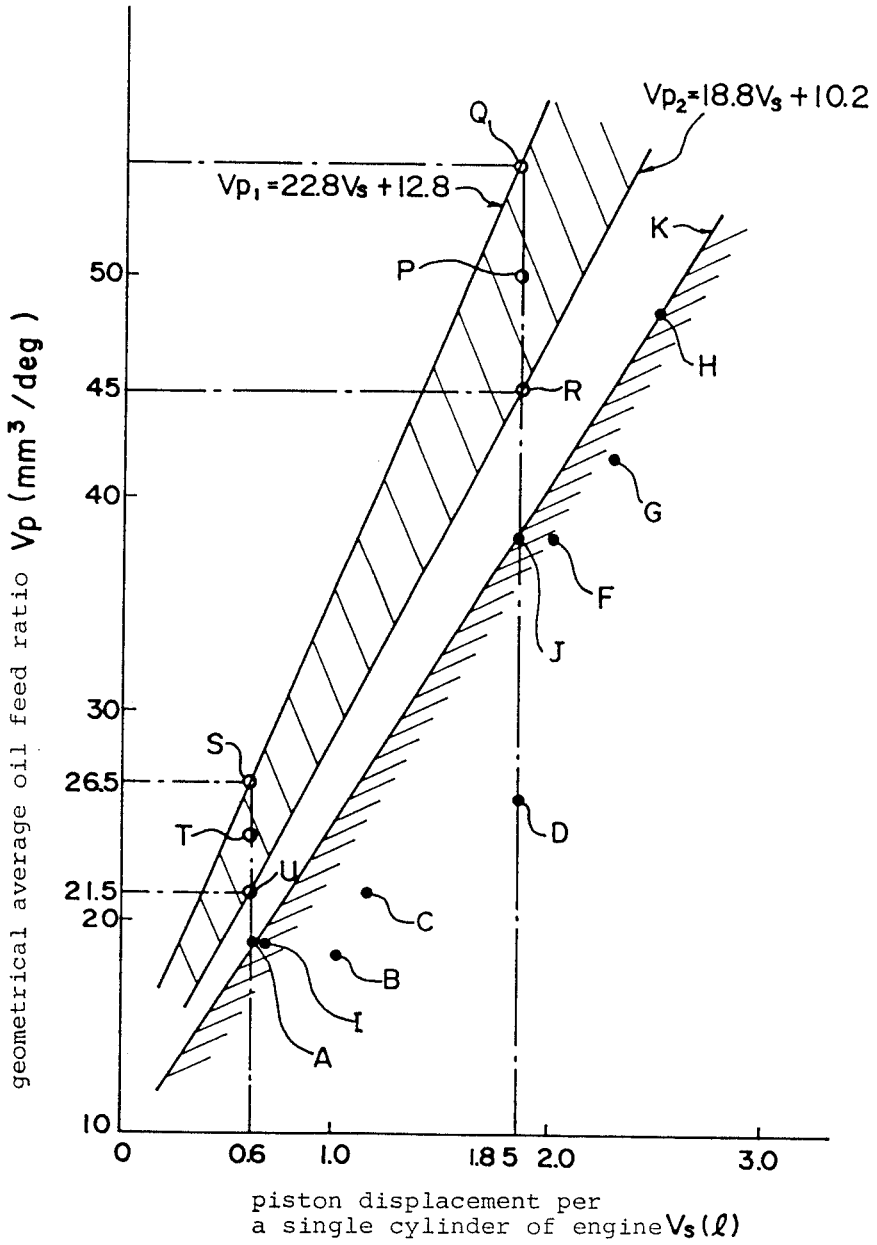
FIG. 20 is a graph showing the relation between the piston displacement per each cylinder of the engine and the geometrical average oil feed ratio.

A cam diagram which will be obtained by shaping the profile of the cam 12 in a cam contour having the dimension shown in FIG. 22 and determining the lift thereof at 14 mm, is shown in FIG. 23. Setting the diameter of the plunger 8 at 12 mm, the geometrical average oil feed ratio $V_p$ obtained in this connection is sought as follows;

$V_p=2.47\times10^{-2}\times D^2\times h=2.47\times10^{-2}\times12^2\times14\approx49.8$ mm$^3$/deg, and this is described as the point P in the graph of FIG. 20. In the same manner, the geometrical average oil feed ratio $V_p$ is found as $V_p\approx55$ and described as the point Q in the graph of FIG. 20, when the plunger diameter D is 12 and the lift h is 15; $V_p\approx45$ as the point R when D=12 and h=12.5; $V_p$26.5 as the point S when D=9.5 and h=12; $V_p\approx24.5$ as the point T when D=9.5 and h=11; and $V_p\approx21.5$ as the point U when D=9.5 and h=9.6, respectively. The respective points P to U are arranged in the table of FIG. 24.

Thus, it is understood that if the cam lift is increased with respect to the plunger diameter, as compared with the table of FIG. 18, the average oil feed ratios $V_p$ will be plotted in the upper portion over the straight line K, as shown in FIG. 20.

In an in-line injection pump, in general, there is a certain limitation even in enlargement of the diameter of a plunger, because of a restriction in the arrangement interval of barrels each mounted on the plunger. If the plunger diameter is enlarged, the whole length of the injection pump will become longer, with its mounting on an engine made difficult. If the height of a pump housing mounted on an engine exceeds the upper end of the engine in a large extent, it will be undesirable from the angle of the engine's loading property. From this point of view, there is a limitation on the heightening of a cam lift. Furthermore, there are also limitations in increasing the foundation circle and cam lift of the cam 12, because the position of fixing bolt holes in use for fixing the pump on an engine is restricted.

In order to determine the plunger diameter and cam lift which may be adaptable, in consideration of the planning conditions for these respective pumps, the average oil feed ratios $V_p$ must fall within such a range (this is the obliquely lines portion in FIG. 20) that the related expression $V_p=2.47\times10^{-2}\times D^2\times h$ is satisfied between both the relations of the straight line $V_{p1}=22.8\ V_s+12.8$ which connects the point Q and point S and the straight line $V_{p2}=18.8\ V_s+10.2$ which connects the point R and point U, as shown in FIG. 20, and the plunger diameter D and cam lift h can be selected for adaptation so as to satisfy the related expression $V_p=2.47\times10^{-2}\times D^2\times h$, on the basis of $V_p$ existing in that range. The sign $V_s$ used here expresses a piston displacement (1) per a single cylinder of the engine.

Figures 24, 25:
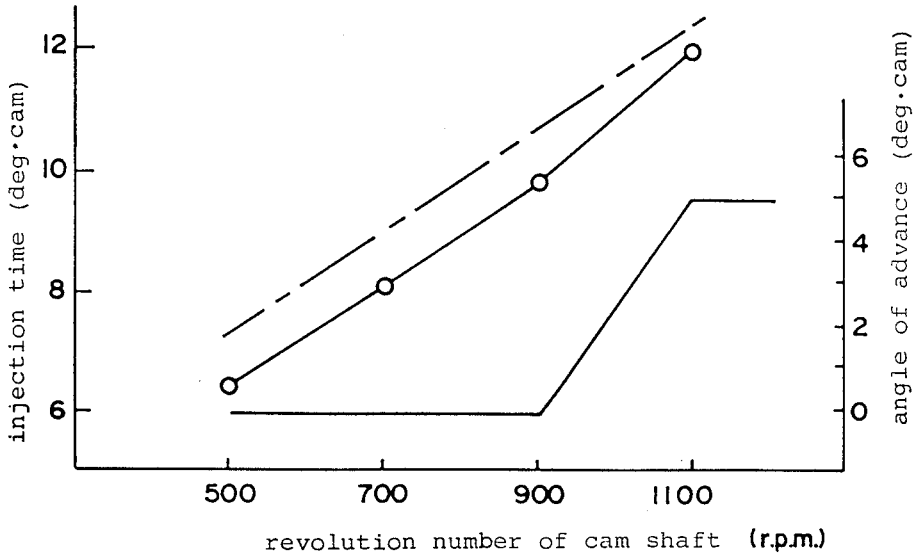
FIG. 24 is a table showing the dimensions of the parts of the fuel injection pumps having performances designated by the points P, Q, R, S, T and U in FIG. 20.
FIG. 25 is a characteristic diagram obtained in the first embodiment.

By means of the fuel injection pump according to the invention which has a plunger diameter and cam lift determined as mentioned above, the engine output can be increased because it acts as a fuel injection pump whose delivery pressure is high when the engine is in medium and low speed regions, and the engine can be operated under the optimum control because it is kept at the state of the maximum delivery pressure and its injection timing is advanced when the engine is in a high speed region. As shown in the graph of FIG. 25, furthermore, the fuel injection pump of this invention (by the solid line) is composed so that the injection time becomes shorter throughout the whole of the engine speed regions, as compared with the aforementioned conventional injection pumps (by the single-dotted chain line), and it has various operational effects such as an improvement in the rate of fuel consumption proportional to the injection time shortened and a betterment in the exhaust gas performance of the engine.

In FIG. 21, the straight line L expresses the delivery pressure in the case of a pump having D=12.5 and h=14 and the straight line N that in the case of a pump having D=12 and h=13, respectively. In there cases, it is also possible to restrain the delivery pressure while the revolution number of the cam shaft reaches the point M", by conducting the advancing control. Although the abovementioned descriptions have been made as to the pump withstanding pressure of 800 kg/cm$^2$, the pump withstanding pressure is not limited to that value. The delivery pressure has been made to accord almost with the pump withstanding pressure between the points M''' and M", but the prestroke of the pump may be controlled as a matter of course so that the delivery pressure is below its withstanding pressure.

On this embodiment, furthermore, the cam has been used having the profile shown in FIG. 22. If the radius of the cam profile at the point $R_1$ is made large, there will be obtained a speed constant diagram in the form of such a trapezoid as shown by the double dotted chain line a-b-c-d in FIG. 23. In the case of this profile, the speed constant between the points b-c becomes almost constant (although not shown, the lift curve of this cam must be also changed). If an injection of fuel is carried out in the range of this cam angle, fuel particles injected into the combustion chamber will become small and they will be dispersed satisfactorily in the combustion chamber and burnt effectively here, because the average pressure of this injection is larger. And besides, the selection range for the injection timing (in particular the advance timing) will be widened, because the average injection pressure is large.

The second embodiment shown in FIG. 26 to FIG. 30 will be next described, wherein parts common to the first embodiment are designated by the same numerals.

Figure 28:
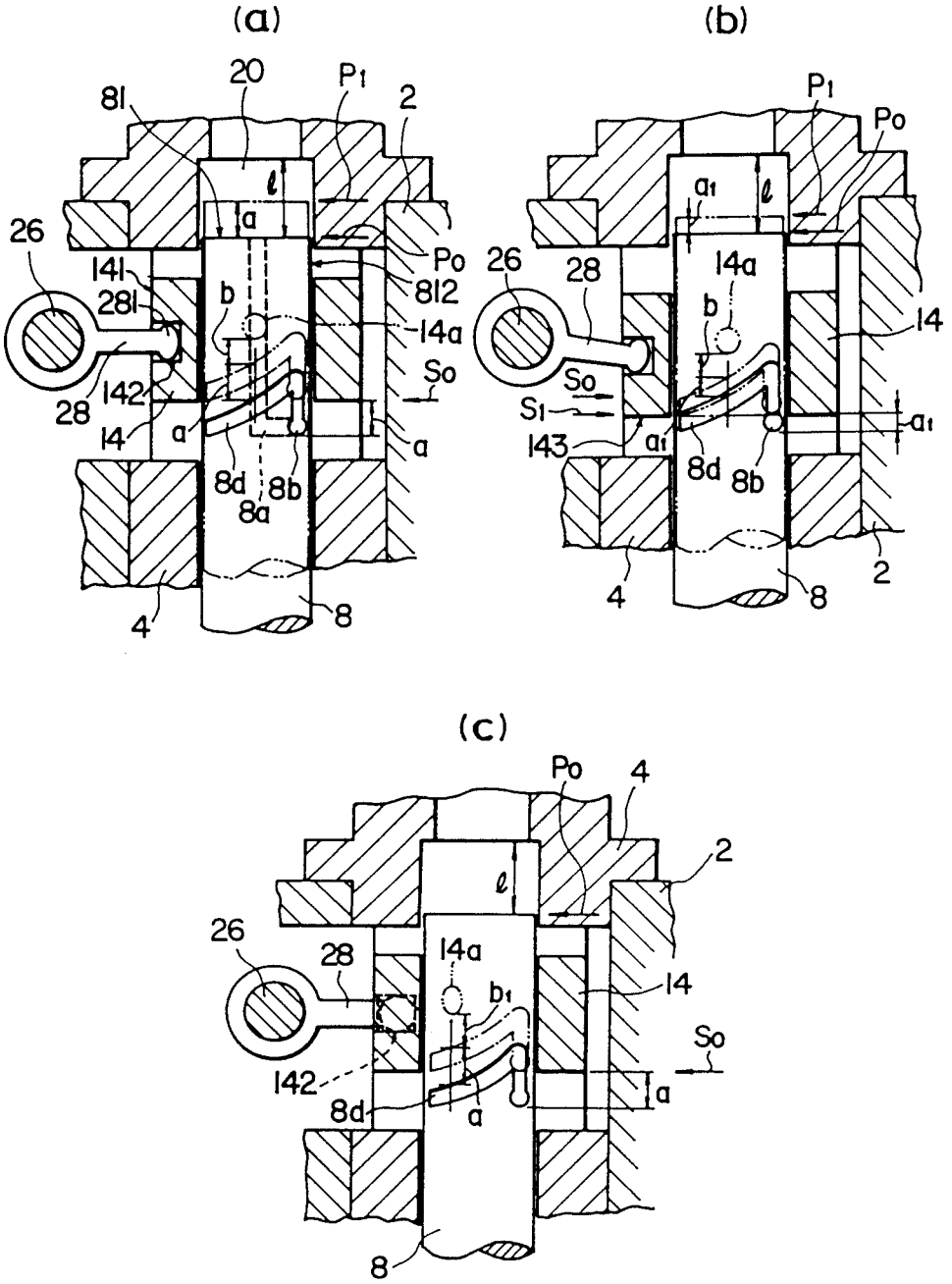
Figure 29:
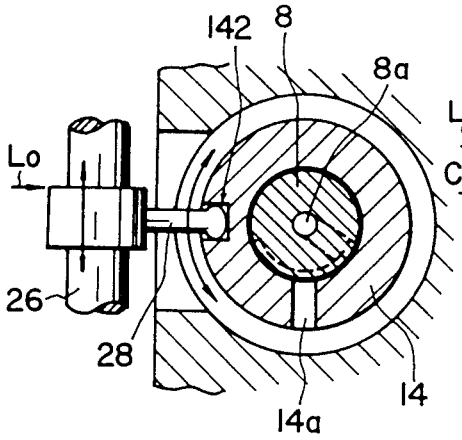
FIG. 29 is a transverse sectional view of the main parts of FIG. 28(*a*)
Figure 30:
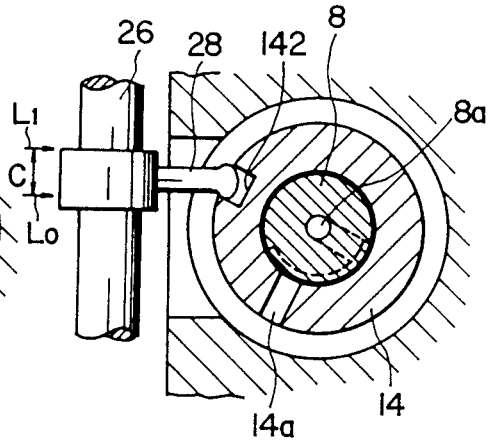
FIG. 30 is a transverse sectional view of the main parts of FIG. 28(*c*)

A control sleeve 14 is mounted on a plunger 8, and the spherical part 281 of the end of an operation lever 28 extended from an operation shaft 26 is fitted into a hole 142 formed on the outer peripheral surface 141 of the control sleeve. As shown in FIG. 28(*a*), the plunger 8 has an oil passage 8*a* which communicates its upper end face 81 and its peripheral side 812 to each other, and an inclined groove 8*d* formed on the peripheral side 812 and communicated at one end with the peripheral side opening of the oil passage 8*a*, whose position in the longitudinal direction of the plunger 8 varies gradually. In the control sleeve 14, on the other hand, its downward face is made as an injection beginning face 143, and a control port 14*a* is formed so as to communicate its inner peripheral side and its outer peripheral side to each other. Accordingly, the plunger 8 makes a lost motion only by a distance a, while it rises from the home position $P_0$ shown by a solid line in FIG. 28(*a*). The effective stroke b of the plunger 8 ranges from the position $P_1$ [shown by a single dotted chain line in FIG. 28(*a*)] where the peripheral side opening of the oil passage 8*a* and the lowermost end of the inclined groove 8*d* reach over the injection beginning face 143 of the control sleeve to the position where the inclined groove 8*d* confronts the control port 14*a* of the control sleeve, and the plunger 8 can pressurize the fuel in a pressurizing chamber 20 which is above the plunger, while it goes in this effective stroke.

Figure 27:
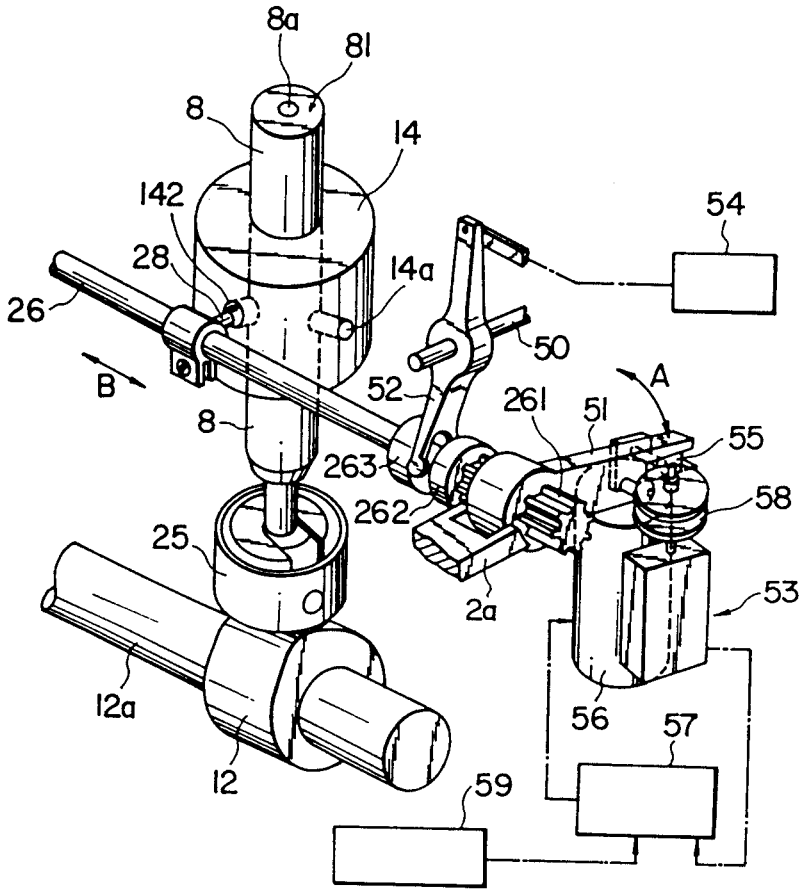
FIG. 27 is a perspective view of the main parts of the injection pump shown in FIG. 26, FIGS. 28(*a*)-28(*c*) are operation illustrative views of a plunger and a control sleeve.

The operation shaft 26 extends along the direction in that other pressurizing units (not shown) in the injection pump are arranged in rows, and it is attached slidably and rotatably to a housing 2 by way of bearings (not shown). On one end of the operation shaft 26, as shown in FIG. 27, there are formed a spline part 261 and a part of flange parts 262 and 263 continuing thereto, respectively. In the spline part 261, there is fixed an injection timing regulation lever (hereinafter called "the first lever" merely) 51 whose movement in the axial direction B of the operation shaft 26 is restricted by a lever restricting member 2*a* on the side of the housing 2 and in which the operation shaft 26 is retained for movement in the axial direction B, whereby the operation shaft 26 can be operated so as to be rotated in the axis-rotating direction A. In the gap between one pair of the flange parts 262 and 263, on the other hand, there is fixed an injection quantity regulation lever (also hereinafter called "the second lever" merely) 52 which is pivotally supported on a pin 50 on the side of the housing 2 and in which the operation shaft 26 is retained for rotation around its axis, whereby the operation shaft 26 can be operated so as to be moved in its axial direction B. An injection timing control means 53 is connected with the turning end of the first lever 51, and a well-known governor 54 which acts as an injection quantity control means is connected with the turning end of the second lever 52. The injection timing control means 53 used here is composed of an electromagnetic solenoid 56 for turning the first lever 51 by way of a slider 55 and a control unit 57 for controlling the solenoid 56, but it may be composed as a manual operation type. In addition, the reference numeral 58 represents a potentiometer for measuring the turning displacement of the first lever 51 in order to actuate the electromagnetic solenoid 56 with accuracy. Various operating state information sources 59 such as an engine speed, degree of an accelerator pedal trod, temperature of cooling water, temperature of intake air, boost pressure of an air intake system and temperature of an exhaust gas, are connected to the control unit 57, and these informations and the information detected by the potentiometer 58 will be synthetically calculated to conduct a more accurate control of the injection timing.

The operation of the injection pump shown in FIG. 26 will be described here. When a Diesel engine (not shown) is driven, a cam shaft 12*a* begins to rotate in interlock with the engine so that the plunger 8 is caused to move up and down. With the vertical movement of the plunger 8, the governor 54 and control unit 57 are actuated to support the control sleeve 14 at a given state by way of the operation shaft 26. Now, it is assumed that the control sleeve 14 has been in its home position $S_0$ [see FIG. 28(*a*)], and then the control unit 57 has first supplied its output current to the electromagnetic solenoid 56 and the first lever 51 has rotated the operation shaft 26 around its axis, whereby the control sleeve 14 has moved down to the position $S_1$ shown in FIG. 28(*b*). Under that state, the plunger 8 begins to rise from its home position $P_0$ and then moves to the position $P_1$ where the lowermost end of the inclined groove 8*d* and the peripheral side opening of the oil passage 8*a* reach over the injection beginning face 143 so that its lost motion distance $a_1$ becomes relatively small and the injection beginning time is therefore advanced. On the contrary, when the control sleeve 14 moves to an upper position over the home position $S_0$, the injection beginning time is delayed. In this regulation of the injection timing, however, the effective stroke b of the plunger does not vary. By virture of the operation of the governor 54, on the other hand, the second lever 52 moves the operation shaft 26 in the axial direction B. Namely, the operation shaft 26 reaches the position $L_1$ which is alienated from its home position $L_0$ (see FIG. 29) by a slide distance C (see FIG. 30), while it turns the control port 14*a* which is the injection end on the control sleeve 14 by a given extent. When the plunger 8 begins to rise from the home position $P_0$, under that state [see FIG. 28(*c*)], the lost motion distance a of the plunger does not vary, as compared with the case shown in FIG. 28(*a*). However, the confronting portion of the inclined groove 8*d* which confronts the control port 14*a* becomes a portion whose position in the longitudinal direction of the plunger is lower [as compared with the case shown in FIG. 28(*a*)], and the effective stroke $b_1$ of the plunger becomes long. On the contrary, when the control sleeve 14 is turned in the reverse direction to the case shown in FIG. 30, the effective stroke becomes short. Thus, the fuel injection quantity per one stroke of the plunger 8 can be regulated by displacing the control port 14*a* of the control sleeve 14.

Figure 26:
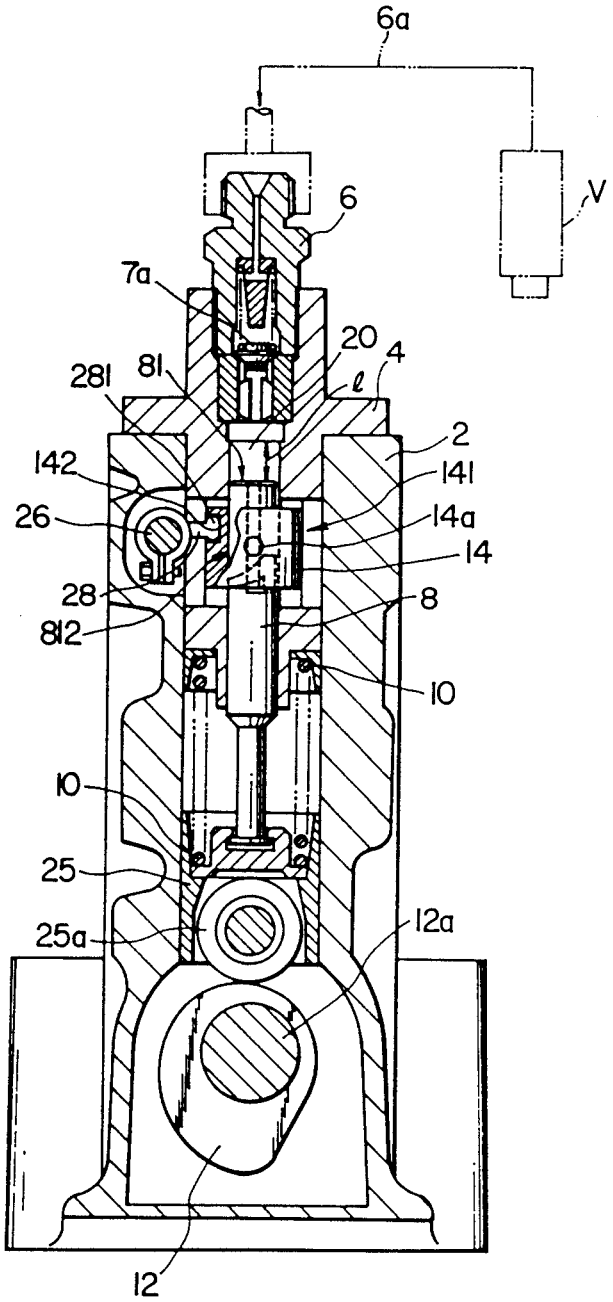
FIG. 26 is a sectional view showing the second embodiment according to the invention.

In the injection pump shown in FIG. 26, namely, the injection timing can be regulated by rotating a single operation shaft 26 in the axis-rotating direction A by means of the first lever 51, and the injection quantity can be also regulated by moving said operation shaft 26 in the axial direction B by means of the second lever 52.

Figure 31:
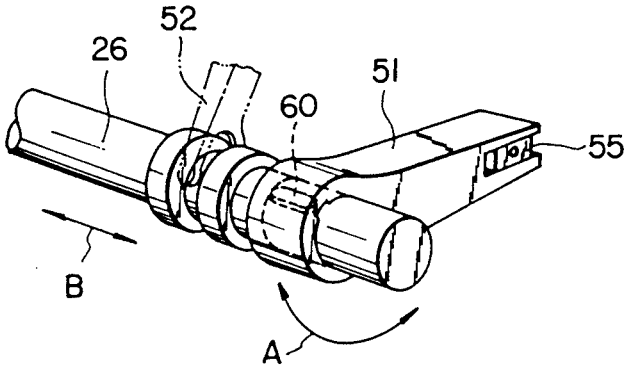
FIG. 31 is a perspective view of the main parts of an operation shaft used in another modification of the second embodiment.

Although the operation shaft 26 has slidably meshed with the first lever 51 by way of the spline part 261 in the abovementioned embodiment, such a composition may be alternatively adapted in which a stud key 60 is fixed on the operation shaft 26 and a slidable first lever 51 is mounted thereon, as shown in FIG. 31. Although the electromagnetic solenoid 56 has been connected with the first lever 51, furthermore, a hydraulic cylinder (not shown) may be used in place of the solenoid.

The third embodiment will be described with reference to FIGS. 32 and 33.

Figure 32:
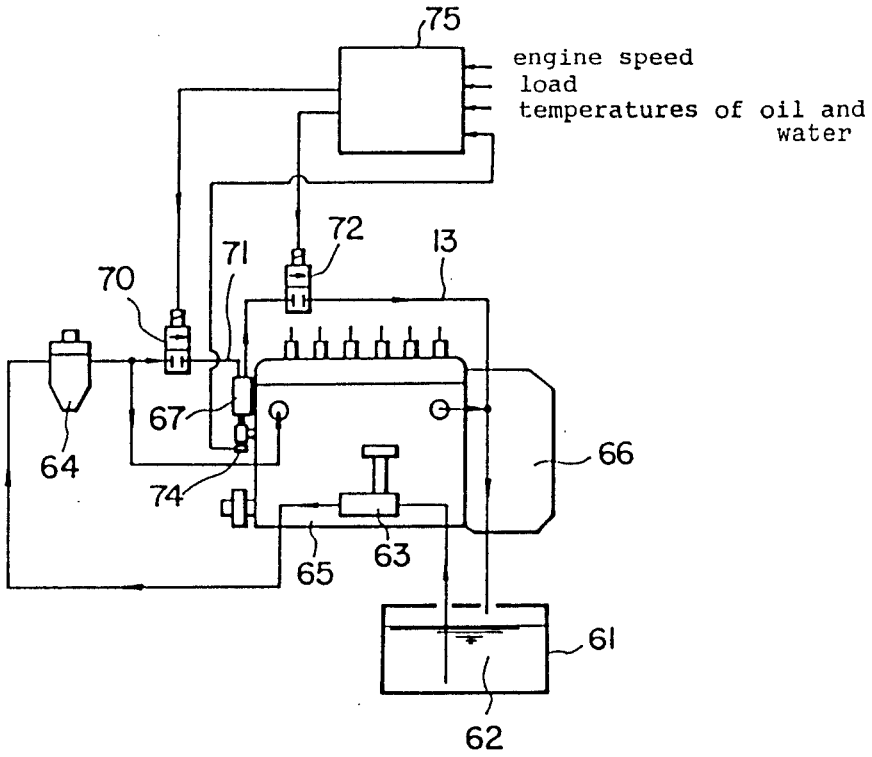
FIG. 32 is a chart of a control circuit in the third embodiment according to the invention.

FIG. 32 shows one example of control circuit for a hydraulic piston driving control device, which utilizes the fuel system of a fuel injection device. The fuel 62 in a fuel tank 61 is sucked up by a feed pump 63 and filtrated by a fuel filter 64, and then it gets into a fuel injection pump 65, where the fuel will be supplied in turn from the respective injection plunges for each cylinder to each injection nozzle. A part of the fuel which has come in the injection pump 65 lubricates the inside of the pump, and then it is recovered together with the leaked part of fuel from the injection nozzle into the fuel tank 61. In addition, the reference numeral 66 represents a governor.

Figure 33:
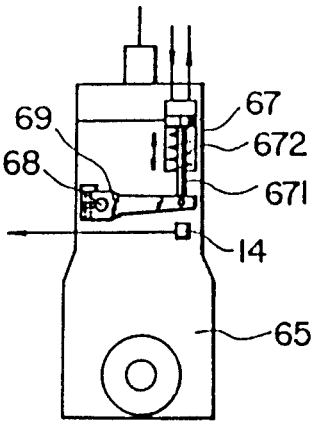
FIG. 33 is a side view of the injection pump shown in FIG. 32.

A hydraulic piston 67 for driving a control sleeve which is used for the prestroke control, in this third embodiment, is fixed on the side of the injection pump 65 opposite to the governor 66, and the fore end thereof is engaged with one end of a lever 69 whose other end is secured on a prestroke control rod 68, as shown in FIG. 33. The prestroke control rod 68 is secured on the base of a shift fork which engages with the outer peripheral groove of the aforementioned prestroke control sleeve. The shift fork is accordingly swinged by way of the lever 69 and the rod 68 by moving the piston rod 671 of the piston 67 up and down, and as a result, the prestroke control sleeve is moved up and down, thereby to change the prestroke.

In this embodiment, the vertical driving of this piston 67 is carried out by utilization of fuel in the fuel system. As illustrated in FIG. 32, namely, a first bypass 71 which leads to the hydraulic piston 67 by way of a first solenoid valve 70 is provided on the fuel delivery side of the fuel system, and a second bypass 73 which leads to the hydraulic piston 67 by way of a second solenoid valve 72 is also provided on the fuel recovery side of the fuel system. The driving of the respective solenoid valves 70, 72 is controlled by the signals from a control part 75 such as a microcomputer which is operated by the signal obtained from a position sensor 74 provided under the piston rod 671, informing what stroke position is the piston now in, this is how long is the stroke now, and such signals as a conventional timer has used to determine the injection timing, for example an engine speed and load, temperature of oil and water and conveying pressure of fuel. In the case it is required to advance the injection timing gradually as the engine speed is gradually increased, it is first judged in accordance with the signal from the position sensor 74 whether the prestroke at that time is proper or not, and when it is not proper, the second solenoid valve 72 is then excited to bring the second bypass 73 into a conducting state in order that the injection timing is advanced correspondingly to the engine speed increased. The fuel in the piston 67 is thereby sucked out and the piston rod 671 is caused to rise by virture of the elasticity of a piston spring 672, and the rod 68 is turned counterclockwise to push the prestroke control sleeve downwards, and as a result, the prestroke is reduced and the injection timing is advanced. In the case that it is required to delay the injection timing, on the contrary, the first solenoid valve 70 is excited to bring the first bypass 71 into the conducting state, whereby the fuel is supplied to the piston 67 to lower the piston rod 671. Thus, the rod 68 is turned clockwise to push the prestroke control sleeve upward, and as a result, the prestroke is made large and the injection timing is delayed. In the control part 75, as a matter of course, there is memorized a correlation between a period of time when the respective solenoid valves 70 and 72 must continue to be exicted and a value to which the engine speed or load has reached.

Since the driving control device for the prestroke control piston according to this third embodiment untilizes the fuel in the fuel injection system skillfully, as mentioned above, it is small and compact in size, with no uselessness, and positive in operation.

Figure 34:
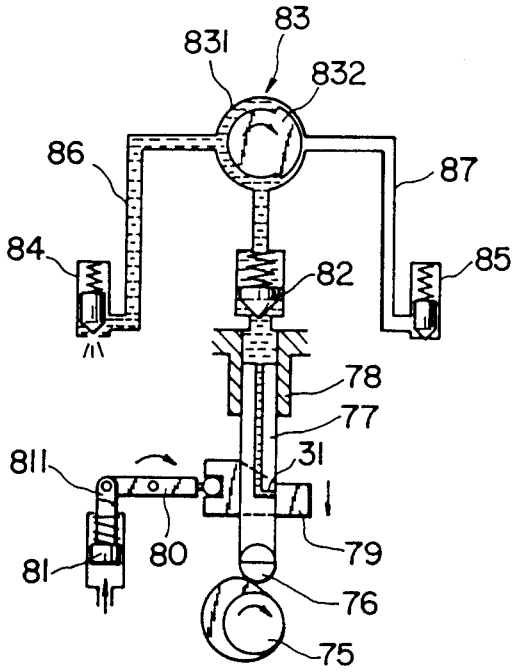
FIG. 34 is a diagrammatic view showing the distribution device of an fuel injection pump in the fourth embodiment according to this invention.

The fourth embodiment will be next described with reference to FIG. 34.

A cam 75 rotates at the same speed as the rotating speed of an engine, and a tappet roller 76 is in contact therewith to reciprocate a plunger 77 provided over the tappet roller with respect to a plunger barrel 78. A control sleeve 79 of a prestroke control device is slidably mounted on a part of the outer periphery of this plunger 77, and one end of a control lever 80 is engaged in a slit part formed on the outer periphery of the control sleeve 79. To the other end of said control lever 80, the actuation rod 811 of a piston 81 is connected, to which piston 81 a pressure oil is supplied from a fuel feed pump. As the prestroke control device, there can be used various types of known devices.

A distributor 83 is connected between a delivery valve 82 placed on the plunger barrel 78 and an fuel injection nozzle of each cylinder. This embodiment is adapted to a two-cylinder engine, and two nozzles 84, 85 are connected to the distributor 83. The distributor 83 has a rotor 832 with a semi-circular slit formed on the outer periphery, which rotates in a housing 831, and said rotor 832 will be driven so as to rotate a fractional time of the number of the cylinders per one revolution of the engine, this is a one-second revolution in this case. While the cam 75 is rotated on time to reciprocate the plunger 77 one time, the rotor 832 is accordingly caused to make a half revolution so that high pressure fuel in the barrel 78 is pumped to the nozzle 84 through an injection pipe 86. With the next one rotation of the cam 75, the rotor 832 is caused to make further a half revolution, whereby the fuel is pumped to the other nozzle 85 through another injection pipe 87. During two revolutions of the engine, or while the piston in the cylinder makes four strokes of suction, compression, combustion and exhaust, one fuel injection is carried to in each cylinder. In the case of a three-cylinder engine, accordingly, the fuel injection may be satisfactorily carried out by providing a slit having a one-third length of the outer periphery of the rotor 832 on the outer periphery and rotating this rotor 832 at a speed which is one-third of the engine speed.

The function of the prestroke control device which is the most important part in this fourth embodiment will be described. Properly speaking, a prestroke control device serves as a timer for regulating a prestroke, thereby to control the fuel injection timing. In this invention, it is used not only as a timer, but also as a means for controlling the fuel injection pressure. By use of the prestroke control device, namely, the prestroke can be made small at the high speed operation of an engine to advance the injection timing of fuel, and at the same time, the oil feed ratio can be reduced to lower the injection pressure, because the portion of the cam whose rotation angle is small is used, with the cam speed lowered, in that fuel injection after all.

The driving of the control sleeve 79 in the prestroke control device is carried out in relation to the detected speed of the engine or the detected oil-feed pressure of the feed pump. In the illustrated embodiment, the driving of the control sleeve 79 is carried out by supplying to the piston 81 a part of the pressure oil to be fed from the feed pump to the plunger 77. Namely, when the engine gets to operate at a high speed, the oil feed pressure for the fuel coming from the feed pump is increased and the piston 81 is pushed up, and as a result, the actuation rod 811 turns the lever 80 clockwise, thereby to push down the control sleeve 79. Thus, the distance between the position of a fuel feed port provided on the control sleeve 79 and the position of a spill port 31 of the plunger 77 when it is at the bottom dead center, is made short and the prestroke is reduced, whereby the injection timing is advanced and the oil feed ratio is reduced, with the injection pressured lowered, as mentioned above.

According to the fourth embodiment in which a prestroke control device is provided on the injection pump of a fuel injection and distribution device and its prestroke is controlled in accordance with the revolution speed of an engine or the oil feed pressure of a feed pump by means of this prestroke control device, it is therefore possible to restrain an undesirable increase in the injection pressure at the high speed operation of the engine, and besides to prevent the generation of secondary injection or cavitation erosion and to improve the durability of the device.

Figure 35:
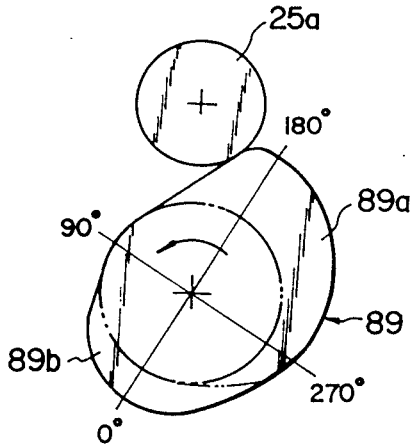
FIG. 35 is a front view of the cam of a fuel injection pump in the fifth embodiment according to the invention.
Figure 36:
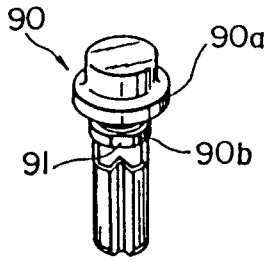
FIG. 36(A) is a perspective view of a delivery valve.
FIG. 36(B) is a front view thereof.
Figure 36:
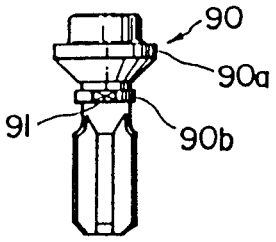
Figure 37:
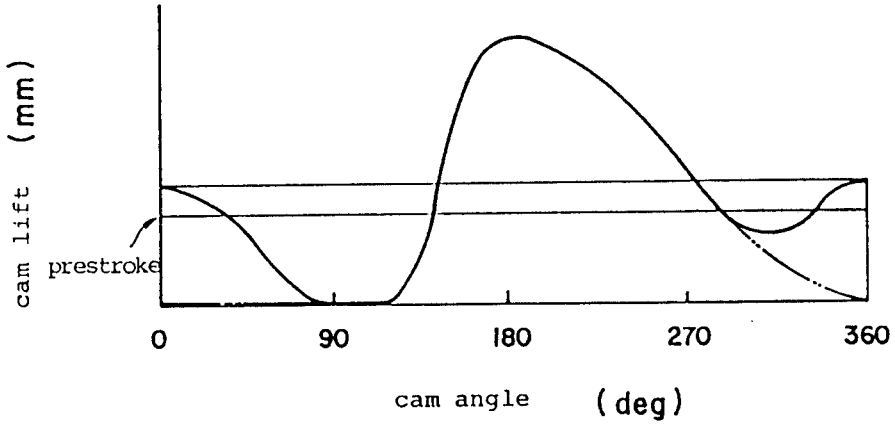
FIG. 37 is a characteristic diagram of a cam.

Referring to FIGS. 35 to 37, the fifth embodiment will be described. All the parts other than a cam 89 and a delivery valve 90 mentioned below, are the same in the structure and contour of these shown in FIG. 4 and FIG. 26, and their description will be omitted because these figures can be adapted to this embodiment.

FIG. 35 shows a cam 89. In this cam 89, its part ranging from 90° to 270° in the drawing is a cam part **89*a* similar to that shown in FIGS. 4 and 26 and its part ranging before and after 0° is an auxiliary cam part 89*b* newly provided. FIG. 36(A) and (B) show a delivery valve 90. On the collar part 90*b* formed under the valve part 90*a* thereof, there is provided a notch part 91 which is called "Angleichung cut". Even when the injection quantity is small, for instance at the light loaded operation of an engine, fuel will be injected through the gap of the notch part 91 if the valve part 90*a* opens slightly a valve seat provided in a delivery valve holder 6. Although the portion from the valve part 90*a* to the lower end of the collar part 90b is set as the suction stroke of the delivery valve 90, the valve 90 is likely to make no displacement over said stroke at the light loaded operation, and said notch part 91** is therefore provided to prevent this no displacement of the valve.

Just after the cam angle goes over 90° as shown in FIG. 37, the cam part **89*a* is brought into rolling contact with said roller 25*a* so that the cam lift becomes gradually large and the plunger 8 is pushed up. When the plunger 8 begins to reach the prestroke position $P_1$, the delivery valve 90 becomes opened so that the pumping of fuel is started. And then, the inclined groove 8*d* confronts the control port 14*a* and the fuel delivery is completed. After that time, the cam lift is further increasing and it becomes the maximum when the cam angle is about 180°. When the cam angle goes over 180°, the plunger 8 begins to fall so as to have a function of returning the fuel from the high pressure system. In the high pressure system, at that time, its residual pressure drops quickly, with a cavitation caused. When the rolling contact position of the cam 89 where it rotates into contact with the roller 25***a* is transferred from the cam part 89*a* to the auxiliary cam part 89*b*, the cam lift is increased again and the plunger 8 goes over the pre-stroke position. As a natural consequence, the delivery valve 90 is caused to open so that the fuel is pumped out. The cam stroke becomes the maximum when the cam angle is at the 020 position, and it is lowering gradually from that state and becomes the minimum when the cam angle is at the 90° position. This minimum stroke of the cam serves merely to send out a very slight quantity of fuel and is useless for the actual fuel injection, but it can increase the residual pressure in the high pressure system to avoid the cavitation positively. Accordingly, when the cam lift is increased again to act the injecting operation, a smooth injection of fuel with good timing can be carried out without any trouble. (The double dotted chain line in the graph represents a change in cam lift obtained by a cam with a conventional cam contour.)

According to the fifth embodiment, as have been explained in the above, an auxiliary cam part is provided on a cam in order to raise the residual pressure in the high pressure system during the fuel pumping stroke once, whereby various effects can be obtained, for example of improving such disadvantages as an actual injection lag and intermittent injection, in particular at the low speed operation of engine, bettering the starting performance of engine and the ratio of fuel consumption, and stabilizing the engine idling.

Figure 38:
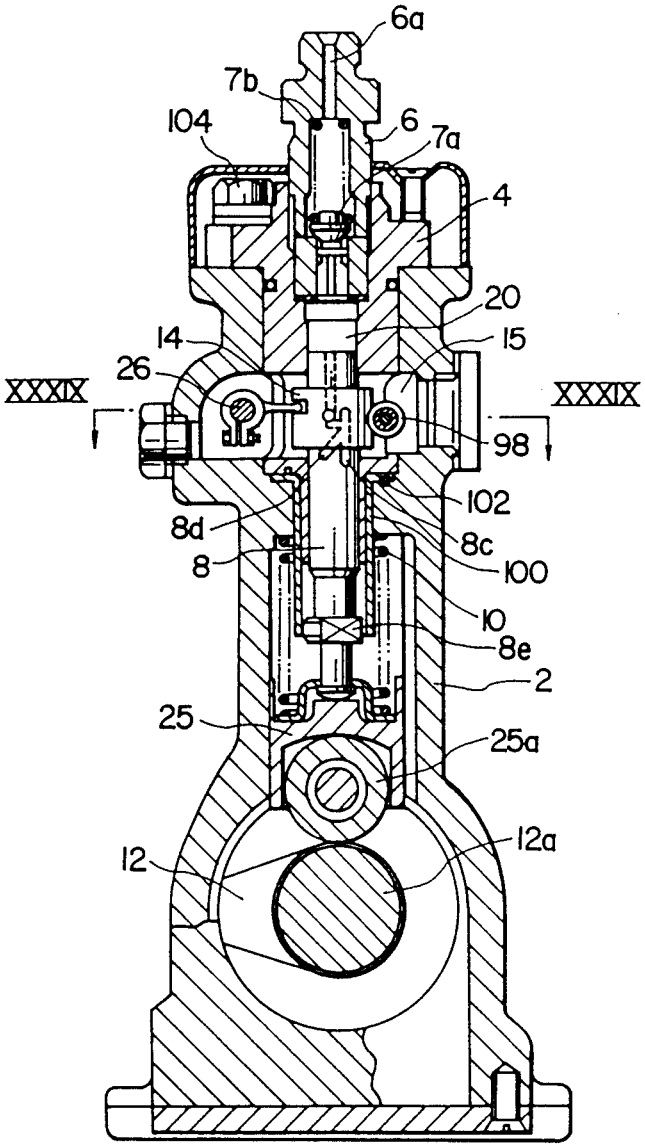
FIG. 38 is a sectional view of an injection pump of the sixth embodiment according to the invention.
Figure 39:
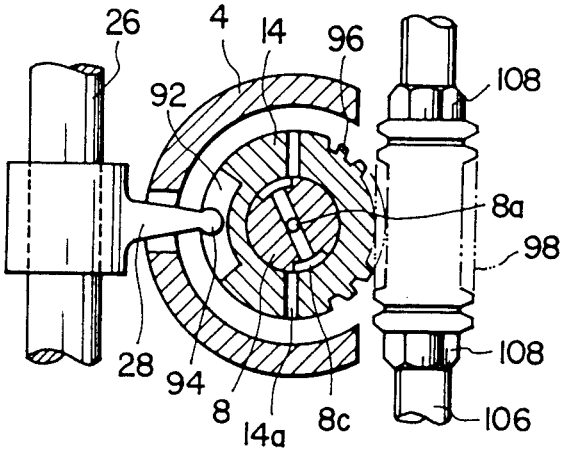
FIG. 39 is a sectional view of the main parts taken along the line XXXIX—XXXIX of FIG. 38.
Figure 40:
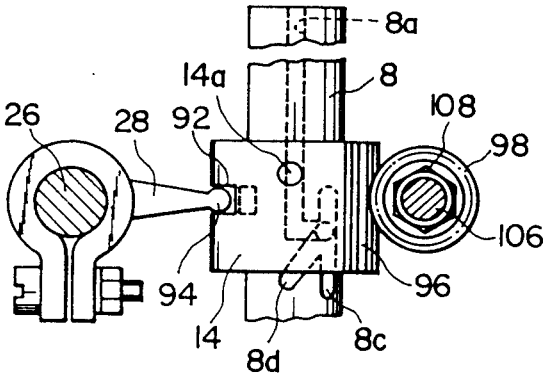
FIG. 40 is a side view of FIG. 39.

The sixth embodiment will be described with reference to FIG. 38 to FIG. 40. The same members as in the aforementioned first embodiment will be omitted in description by marking with the same reference numerals.

The reference numeral 14 represents a cylindrical fuel control sleeve mounted on the outer periphery of a plunger 8 in a fuel chamber 15 so as to be freely slidable in the direction of its axis and rotatable around there; 92 is an arcuate guide groove cut on the outer peripheral surface of the sleeve 14 in a plane intersecting at a right angle with the axis of the plunger 8; 26 is an injection timing control shaft whose axis is contained in a plane perpendicular to the axis of said plunger 8; 28 is an injection timing control arm protruding from the control shaft 26, in which the spherical part 94 on its fore end is inserted in said guide groove 92; 96 is a gear provided on the outer peripheral surface of said control sleeve 14 opposite to said guide groove 92 along nearly the half of its circumference; and 98 is a rack member meshing with said gear 96, which is, in the device shown in the drawings, a cylindrical rack member formed by rolling a rack tooth profile around an axis perpendicular to the axis of the plunger 8, or may be a well-known rack rod. The reference numeral 100 represents a plunger rotation preventing sleeve mounted on the lower end portion of the plunger 8, in which the flange part of its upper end is fixed on a housing 2 by knock pins 102, and the angular sectional part of its lower end is mounted on the angular part 83 on the plunger 8 corresponding thereto, and so a result, the plunger 8 is permitted to displace freely in its axial direction, but can not be rotated around the axis. In addition, this plunger rotation preventing sleeve 100 may be fixed, as to its rotating direction, onto a barrel 4, or may be formed as one body with the barrel 4 and indirectly fixed on the housing 2 by bolts 104.

Since the sixth embodiment has such a composition as mentioned above, the fuel feed quantity can be regulated by moving the rack member 98 in its axial direction to turn the control sleeve 14 around the axis of the plunger 8 and change the related position of control ports 14*a* and a longitudinal groove 8*c* that is a part of a control groove. And, furthermore, the related position of the control ports 14*a* and the control groove in the direction of the cam lift can be changed or the injection timing can be regualted by turning the control shaft 26 around its axis to displace the control sleeve 14 in the axial direction of the plunger 8 by way of the control arm 28.

In order to match uniformly the fuel injection quantities of the injection pump for a plurality of cylinders, furthermore, according to this sixth embodiment, said rack member 98 is screw-engaged on a screw shaft 106. By the relative turning of the rack member 98 to the screw shaft 106 in a proper direction, the rack member 98 can be therefore moved in its axial direction along the screw shaft 106, and in other words, the control sleeve 14 can be moved to a desired related position around the plunger 8. After completion of this adjustment, the rack member 98 is fixed to the screw shaft 106 by means of fixing nuts 108. As a result, the fuel injection quantity of the injection pump can be advantageously regulatd easily and quickly so as to be matched uniformly in every cylinder. In the aforementioned embodiment, in addition, the control groove has been provided on the plunger 8 and the control ports cooperating therewith has been provided on the control sleeve 14, but it may be so composed likely to the aforementioned well-known device that a control groove inclined with respect to the plunger axis is provided on the side of the control sleeve 14 and control ports communicated to the oil passage 8*a* are opened on the outer peripheral surface of the plunger 8.

The seventh embodiment will be described here with reference to FIG. 38 to FIG. 41.

Figure 41:
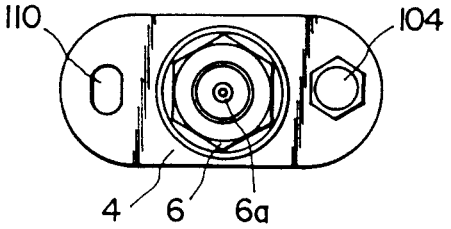
FIG. 41 is an upper end view of a barrel 4 in the seventh embodiment according to the invention.
Figure 42:
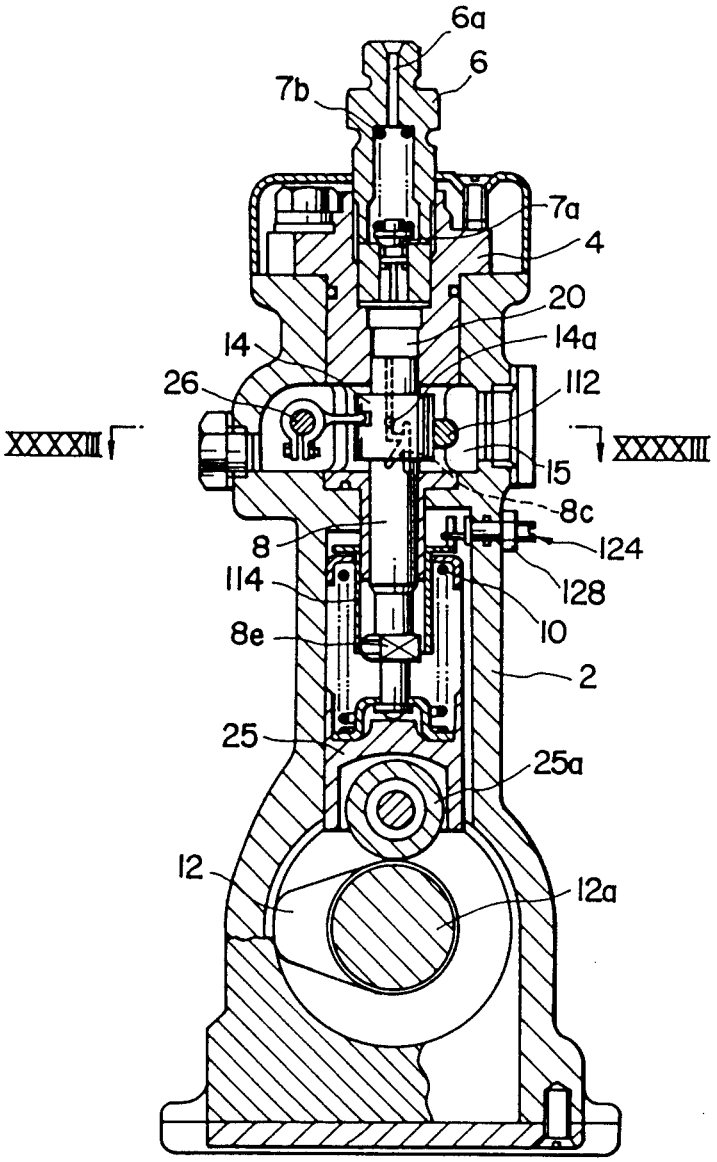
FIG. 42 is a sectional view of a pump in the eighth embodiment.

Although the barrel 4 has been removably mounted on the upper end of the housing 2 and the upper end flange part of the plunger rotation preventing sleeve 100 has been fixed on the housing 2 by the knock pins 102 in the aforementioned sixth embodiment, the seventh embodiment differs from the sixth embodiment only on the point of view in which it is so composed that the upper end flange part of a plunger rotation preventing sleeve 100 may be fixed on the barrel 4, not on the housing 2, or that sleeve 100 may be formed as one body with the barrel 4 so as to be fixed together with the barrel 4 directly onto the housing 2 by means of bolts 104. The other composition of the seventh embodiment is the same as the sixth embodiment. In order to match uniformly the fuel injection quantities of the injection pump for a plurality of cylinders, the fine regulation of these injection quantities is carried out by turning the barrel 4 and the plunger 8 as one body around the plunger axis in a proper direction to change their relative related position to the control sleeve 14, and in other words, to change the relative position of the control ports 14*a* to the control groove, before the barrel 4 is fixed to the housing 2 by the bolts 104. To this end, as shown in FIG. 41, the seventh embodiment is composed so that bolt holes 110 on the barrel 4, which cooperate with the bolts 104, are formed as long holes, thereby to enable the barrel 4 to turn around the plunger axis. As a result, there is an advantage of finely regulating the injection quantities of the fuel injection pump for every cylinder quickly and easily to match them to one another.

Since the rack member 98 is also screw-engaged on the screw shaft 106 in the same way as the sixth embodiment, the rack member 98 can be moved in the axial direction of the screw shaft by turning the rack member 98 in a proper direction with respect to the screw shaft, and in other words, the control sleeve 14 can be moved to a desired related position around the plunger 8, thereby to conduct the fine regulation of the injection quantity secondarily. As a matter of course, said rack member 98 is fixed at a given position by the fixing nuts 108 similarly to the sixth embodiment.

The eighth embodiment will be next described below with reference to FIG. 42 to FIG. 45.

The reference numeral 2 represents a housing of a fuel injection pump; 4 is a barrel detachably mounted on the upper end of said housing; 20 is a fuel pressurizing chamber formed in the barrel 4; 7*a* is a fuel delivery valve contained in a delivery valve holder 6 screw-engaged in the upper end of said barrel 4, which is preloaded by a spring 7*b* to block up said pressurizing chamber 20; 6*a* is a delivery passage formed in said delivery valve holder 6 and communicated to a fuel injection nozzle through a fuel injection pipe (not shown); and 8 is a plunger slidably mounted in the housing 2 by way of said barrel 4, whose upper end face faces to said pressurizing chamber 20 and whose end part is in contact with a cam 12 by way of a cam holder (tappet) 25 and a roller 25*a*. The reference numeral 12*a* represents a cam shaft which is driven by an engine (not shown); 10 is a spring which forces always said cam holder 25 to the side of the cam 25; and 15 is a fuel chamber formed so as to surround said plunger 8, to which fuel is always supplied by means of a feed pump (not shown) during the operation of the engine. The reference numeral 14 represents a cylindrical fuel control sleeve mounted on the outer periphery of the plunger 8 in the fuel chamber 15 so as to be freely slidable in the axial direction of the plunger and rotatable around there; 92 is an arcuate guide groove cut on the outer peripheral surface of the sleeve 14 in a plane intersecting at a right angle with the axis of the plunger 8; 26 is an injection timing control shaft whose axis is contained in a plane perpendicular to the axis of said plunger 8; 28 is an injection timing control arm protruded from the control shaft 26, in which the spherical part 94 on its fore end is inserted in said guide groove 92; 96 is a gear provided on the outer pheripheral surface of said control sleeve 14 opposite to said guide groove 92 along nearly the half of its circumference; 112 is a rack rod meshing with said gear 96; and 8*a* is an oil passage in the plunger, in which one end thereof is opened into said pressurizing chamber 20 and the other end thereof is communicated with a control groove 8*c*, 8*d* cut on the outer peripheral surface of the plunger contacting with said control sleeve 14, the control groove being composed of a portion 8*d* inclined with respect to the plunger axis and a portion 8*c* extending in the axial direction of the plunger and shaped in the letter λ (lambda) on the whole. The reference numeral 14*a* represents control ports perforated in said control sleeve 14 in the radial direction and cooperating with said control groove; and 114 represents a hollow tube-shaped plunger guide mounted on the lower end portion of the plunger 8, in which the angular sectional part 116 on its lower end is fitted on the angular part 8*e* on the plunger 8 corresponding thereto, and as a result, the plunger 8 is permitted to displace freely in its axial direction with respect to the barrel 4 and plunger guide 114, but can not be relatively rotated around its axis with respect to the plunger guide 114. On the outer circumferential portion of the upper end flange of the plunger guide 114, as illustrated in detail in FIG. 45, there is provided a projection 120 with an axial engagement groove 118. In the wall surface of the housing 2 which is opposited to the projection 120, on the other hand, there is rotatably mounted a regulation member 124 having an eccentric pin 122 to be engaged in said engagement groove 118, and the regulation member 124 is devised so that a lock nut 128 is screw-engaged with its screw part 126 protruded to the outside of the housing 2.

When the respective members of the fuel pump are in the illustrated positions, in the aforementioned device, the control ports 14*a* and the control groove 8*c*, 8*d* are not in communication with each other and the lower ends of the control groove are protruded downward from the lower end face of the control sleeve 14 so as to be opened into the fuel chamber 15, and as a result, the pressurizing chamber 20 and the fuel chamber 15 are kept in communication with each other. When the cam shaft 12*a* is now rotated by the engine from this state and the plunger 8 is pushed upward by way of the roller 25*a* by the cam 12, the lower ends of said control groove are closed by the control sleeve 14 so that the communicatoin between the pressurizing chamber 20 and the fuel chamber 15 is interrupted because the communication between the inclined portion fo the control groove and the control port 14*a* is kept interrupted. The fuel in the pressurizing chamber is therefore pressurized with the rise of the plunger 8, and when its pressure exceeds a set value, the delivery valve 7*a* is opened whereby the fuel is fed from the delivery passage 6*a* to the injection nozzle of the engine. When the plunger 8 rises further so that the inclined groove portion 8*d* of the control groove is brought into communication with the control port 14*a* of the control sleeve 14, the pressurizing chamber 20 communicates to the fuel chamber 15 again and the fuel injection is finished. Thus, the upper end of the axial portion 8*c* of said control groove is protruded upward from the upper end face of the control sleeve 14 to communicate the pressurizing chamber 20 and fuel chamber 15 directly, thereby to prevent the two-stage injection of fuel positively. By moving the rack rod 112 in its axial direction and turning the control sleeve 14 around the axis of the plunger 8 to change the related position of the control port 14*a* and control groove, thereafter, the fuel feed quantity is increased or reduced. By turning the control shaft 26 around its axis to displace the control sleeve 14 in the axial direction of the plunger 8 by way of the control arm 28, the related position of the control port 14*a* and control groove in the direction of the cam lift is changed, or the injection timing is regulated. In addition, said rack rod 112 and control shaft 26 each are driven artifically by an engine control device (not shown) such as an accelerator, governor or timer in the case of a motor vehicle, or by a proper actuator.

According to this eighth embodiment, the lock nut 128 is relaxed and the regulation member 124 is turned by use of a tool such as a screw driver, when the injection quantities of the injection pump for a plurality of cylinders are matched uniformly. Then, the plunger guide 114 is turned together with the plunger 8 around the plunger axis in a proper direction, owing to the co-operation of the eccentric pin 122 and the engagement groove 118 so that the relative related position of the plunger to the control sleeve 14 is changed, and in other words, the relative position of the control port 14*a* to the control groove is changed, thereby to conduct the fine regulation of the injection quantity of the fuel injection pump for each cylinder. Thus, the injection quantities of the injection pump for all the cylinders are matched with one another and the lock nuts 128 of the respective regulation members 124 each are then tightened to fix each regulation member 124 onto the housing 2. At that time, the plunger guides 114, and therefore the plungers 8, each are accurately related to the control sleeve 14 confronting thereto, by way of the eccentric pin 122 and engagement groove 118. As a result, there is an advantage of finely regulating the injection quantities of the fuel injection pump for every cylinder quickly and easily to match them uniformly. In the aforementioned embodiment, the control groove has been provided on the plunger 8 and the control ports 14*a* cooperating therewith have been provided on the control sleeve 14, but it may be so composed that a control groove inclined with respect to the axis of the plunger is provided on the side of the control sleeve 14 and control ports communicating with the oil passage 8*a* are opened on the outer peripheral surface of the plunger 8. Although a combination of the eccentric pin 122 and the engagement groove 118 has been used in the aforementioned embodiment, it is obvious that a positive cam device composed of a cam and a cam groove, having the same effects viewed at the angle of the mechanics, can be equally substituted therefor.

Referring to FIG. 46 to FIG. 49, the ninth embodiment will be described. Explaining only parts different in composition from the eighth embodiment, a fuel chamber 15 formed so as to surround a plunger 8 is divided into an oil feed chamber 15*a* and an oil discharge chamber 15*b*, and the oil feed chamber 15*a* is always supplied with fuel by means of a feed pump (not shown) during the operation of an engine and the oil discharge chamber 15*b* is communicated with the suction side of the feed pump or a fuel tank. A somewhat triangular control groove 130 is cut on the outer peripheral surface of the plunger which contacts with a control sleeve 14, and one end of an oil passage 8*a* in the plunger is opened into a pressurizing chamber 20 and the other end thereof is communicated with the control groove 130. Said control groove 130 has an upper side portion inclined with respect to the plunger axis. The reference numeral 131 represents an oil feed port in which one end thereof is opened to the outer peripheral surface of the plunger 8 and the other end thereof is communicated with said oil passage 8*a*, and in this embodiment, said oil feed port 131 is arranged with an angle interval of about 180° from said control groove 130 around the plunger axis and opened somewhat below the bottom side of the control groove 130, as clearly shown in FIG. 47 and FIG. 48. The reference numeral 132 represents an oil discharge port perforated in the radial direction in said control sleeve 14, which co-operates with said control groove 130. And, the reference numeral 134 represents partition plate protrudedly provided in the radial direction in said barrel 4; and 136 represents partition plates protrudedly provided in the housing 2 toward the barrel 4. All of these partition plates serve to divide said fuel chamber 15 into the oil feed chamber 15*a* and the oil discharge chamber 15*b*.

As for the aforementioned device, the operation mode of the fuel pump will be described in detail by making reference to FIG. 49(A) to FIG. 49(E) mainly. In all FIGS. 49(A) to 49(E), the inner peripheral surface of the control sleeve 14 and the outer peripheral surface of the plunger 8 cooperating therewith are shown as they are developed and overlapped to each other. When both of them are at first in the position shown in FIG. 49(A), the oil discharge port 132 and control groove 130 are not in communication with each other and the lower end of the oil feed port 131 gets downward out of the lower end face of the control sleeve 14 and opens to the oil feed chamber 15*a* of the fuel chamber 15, and as a result, the pressurizing chamber 20 and the oil feed chamber 15*a* are communicated with each other. If the cam shaft 12*a* is now rotated by the engine from this state and the plunger 8 is pushed upward by way of the roller 25*a* by the cam 12 so as to come to the position shown in FIG. 49(B), the lower end of said oil feed port 131 is closed by the control sleeve 14 and the communication between the inclined portion of the control groove 130 and the oil discharge port 132 is kept interrupted so that the communication between the pressurizing chamber 20 and the fuel chamber 15, or both the oil feed chamber 15*a* and oil discharge chamber 15*b* is interrupted. Accordingly, the fuel in the pressurizing chamber 20 is pressurized with the rising of the plunger 8, and when its pressure exceeds a set value, a delivery value 7*a* is opened, whereby the fuel is fed from the delivery passage 6*a* to the injection nozzle of the engine. When the plunger 8 rises further and reaches the position shown in FIG. 49(C), the inclined oblique portion of the control groove 130 is communicated with the oil discharge port 132 of the control sleeve 14 so that the pressurizing chamber 20 is communicated with the oil discharge chamber 15*b* of the fuel chamber 15, thereby to complete the fuel injection. Then, the upper end of the axial portion of said control groove 130 reaches the position of FIG. 49(E) from the position of FIG. 49(D) and gets upward out of the upper end face of the control sleeve 14 whereby the pressurizing chamber 20 and fuel chamber 15 are directly communicated with each other to prevent the two-stage injection of fuel positively. In addition, the fuel feed quantity is increased or decreased by moving a rack rod 112 in its axial direction to turn the control sleeve 14 around the axis of the plunger 8 so that the related position of the oil discharge port 132 and the control groove 130 is changed. And, the related position of the oil discharge port 131 and the control groove 130 in the direction of the cam lift is changed, and namely the injection timing is regulated, by turning a control shaft 26 around its axis so that the control sleeve 14 is displaced in the axial direction of the plunger 8 by way of a control arm 28.

In the abovementioned fuel pump, the fuel whose temperature is rised through its compression, after the fuel injection is completed, is caused to flow out of the pressurizing chamber 20 into the oil discharge chamber 15*b* and then returned to the suction side of the feed pump or a fuel tank (not shown). Accordingly, this fuel pump can restrain the temperature rise of the fuel effectively in comparison with the aforementioned pump devices already proposed in which the fuel chamber 15 is not divided into the oil feed chamber 15*a* and oil discharge chamber 15*b*, and can effectively prevent undesirable variations in the injection characteristics caused by the rise of the fuel temperature. As clearly understood from the above description, said partition plates 134 and 136 which divide the fuel chamber 15 into the oil feed chamber 15*a* and oil discharge chamber 15*b* are enough only to perform a function of preventing the mixing of the fuel coming into the pressurizing chamber 20 and the high temperature fuel flowing out of the pressurizing chamber 20 after completion of the fuel injection in some extent, and must not keep a strict oil-tightness between them. In addition, the angular interval between the control groove 130 and oil feed port 131 provided on the outer peripheral surface of the plunger 8 around the plunger axis is not limited to an angle of about 180° shown in the drawings, and it may be 90° or may be as large as 60°. In short, a proper angular interval may be selected so as to obtain a well-balanced state with said partition plates 134 and 136 generally demarcating the oil feed chamber 15*a* and the oil discharge chamber 15*b*, and in particular with the former partition plates 134.

Figure 50:
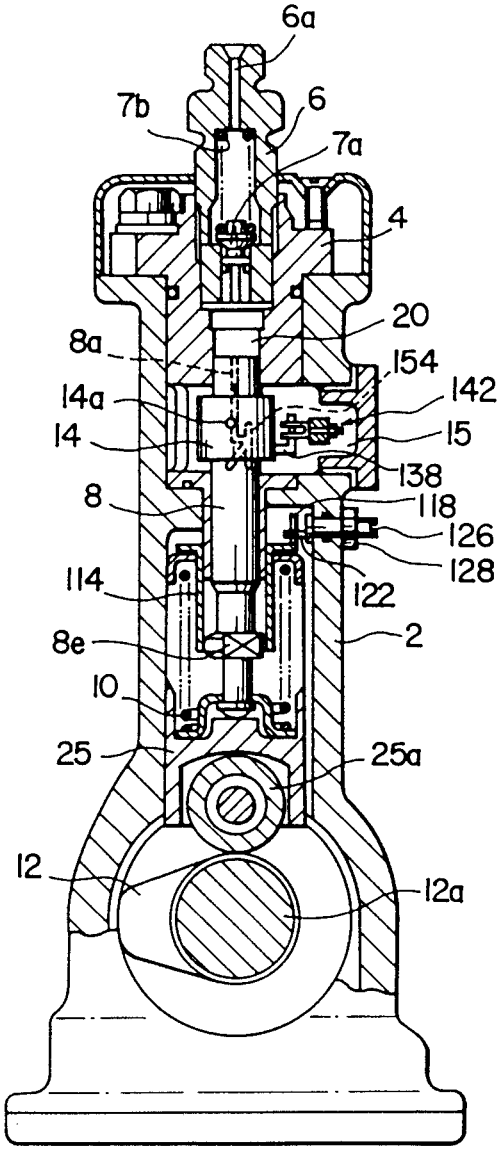
FIG. 50 is a sectional view of a pump in the tenth embodiment.

The tenth embodiment will be described here with reference to FIGS. 50 and 51.

The tenth embodiment is different from the eighth embodiment at the viewpoint that the vertical movement of the control sleeve 14 is controlled by the control shaft 26 and the turning thereof by the rack rod 112 in the eighth embodiment, but the tenth embodiment is so composed that both the vertical movement and turning of a control sleeve 14 are controlled by only one control shaft member 142. The reference numeral 138 represents a L-shaped flow regulation pin whose one end is secured on the outer peripheral surface of the control sleeve 14, and on its vertical pin 138*a* extended in the direction of the plunger axis, there is secured an injection timing regulation pin 140 which extends so as to intersect the plunger axis at a right angle. The reference numeral 142 represents generally a control shaft member which cooperates with said flow regulation pin 138 and injection timing regulation pin 140, and this control shaft member 142 is composed of an injection quantity control member 144 connected with a proper actuator such as a linear solenoid (not shown) for giving a straight motion so as to be displaced in the direction of the arrows A and A', and an injection timing control member 146 engaged with the injection quantity control member 144 telescopically in the axial direction and connected with a proper actuator such as a rotary solenoid (not shown) so that said injection quantity control member 144 is turned around its axis by the turning of the injection timing control member itself around the axis, as shown in detail in FIG. 51. The reference numeral 148 represents an engagement member which is protrudedly provided on the angular sectional portion of said injection quantity control member 144 toward said control sleeve 14, and this engagement member 148 has a first groove 150 which engages slidably with the vertical pin 138*a* of the flow regulation pin 138, and a second groove 152 which engages slidably with said injection timing regulation pin 140.

Figure 51:
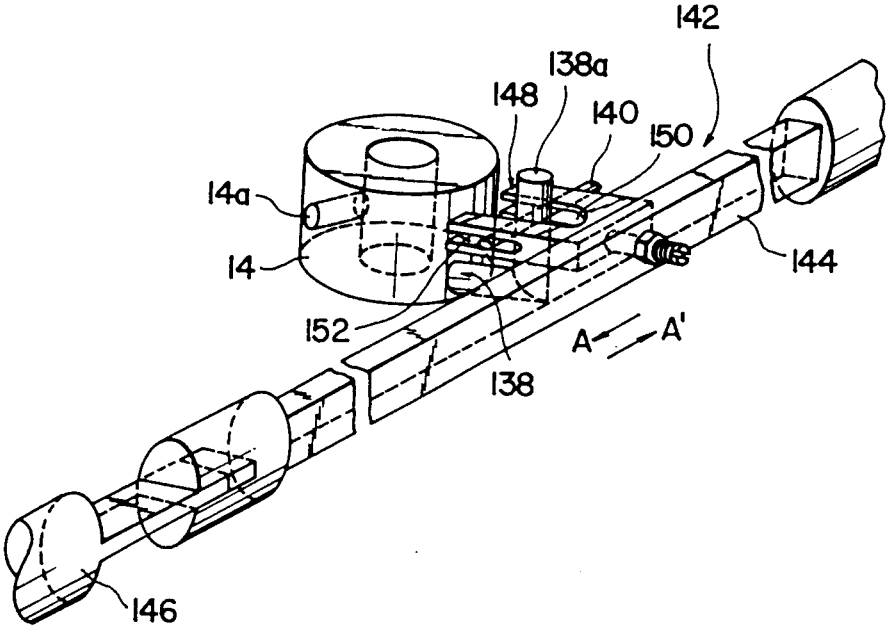
FIG. 51 is a perspective view showing the control sleeve and control shaft taken from FIG. 50.

According to this tenth embodiment which has the aforementioned composition, the movement of the injection quantity control member 144 in its axial direction, for example in the direction of the arrow A in FIG. 51 by means of the actuator causes the engagement member 148 to displace in the direction A so that by virtue of the cooperation of its first groove 150 and the vertical pin 138*a*, the flow regulation pin 138 and therefore the control sleeve 14 are turned clockwise around the axis of the plunger 8 and the related position of a control port 14*a* and a control groove 154 is changed, whereby the fuel feed quantity is regulated. By turning the injection timing control member 146 around its axis by means of the aforementioned proper actuator such as a rotary solenoid, the engagement member 148 is turned around the axis of the control shaft member 142 so that by virtue of the cooperation of the second groove 152 and the injection timing regulation pin 140, the control sleeve 14 is displaced in the axial direction of the plunger 8 and the related position of the control port 14*a* and control groove 154 in the direction of the cam lift is changed, whereby the injection timing is thus regulated. Since the member for turning the control sleeve 14 around its axis to carry out the control of the fuel injection quantity and the member for displacing the control sleeve 14 in the axial direction to carry out the control of the injection timing are arranged in one side of the sleeve 14 in the radial direction, according to this composition, the device of this embodiment has advantages of being simple in structure as compared with a conventional device and of reducing the lateral size in the portion of the control sleeve 14. Furthermore, the matching of the injection timings of the injection pump for a plurality of cylinders can be carried out by (i) adjusting a shim on the clamping face between the barrel 4 and the housing 2 and (ii) adjusting a shim between the cam holder (tappet) 25 and the lower end if the plunger 8. In addition, the aforementioned embodiment may be composed so that a control groove inclined with respect to the plunger axis is provided on the side of the control sleeve 14 and a control port communicating with the oil passage 8*a* is opened on the outer peripheral surface of the plunger 8, although the control groove 154 has been provided on the plunger 8 and the control port 14*a* cooperating therewith has been provided on the control sleeve 14.

Figure 52:
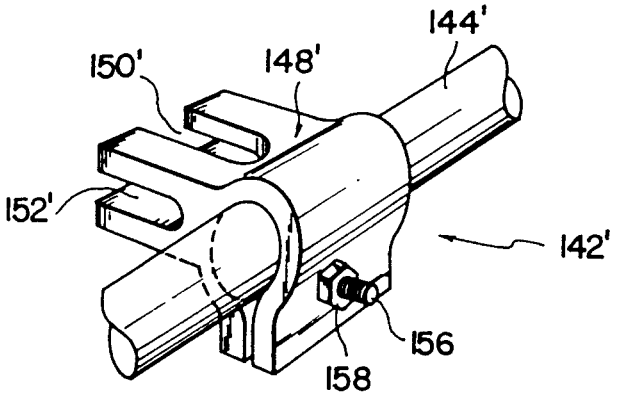
FIG. 52 is a perspective view showing a modification of the tenth embodiment similarly to FIG. 51.

Describing a modification of the aforementioned tenth embodiment with reference to FIG. 52, the reference numeral 144' represents an injection quantity control member having a circular cross-section, on which an engagement member 148' with a first groove 150' and a second grove 152' is mounted and fixed by an adjustment bolt 156 and a nut 158. The fuel injection quantity can be therefore regulated by displacing the injection quantity control member 144' in the axial direction in the same way as the tenth embodiment to rotate the control sleeve 14, and the injection timing can be regulated by turning the injection quantity control member around its axis to move the control sleeve 14 up or down. As to the initial matching of the injection pump for a plurality of cylinders, furthermore, it is possible to match the injection quantities by relaxing said nut 158 to move the engagement member 148' in the axial direction and the injection timings by adjusting the angular position of the engagement member 148' around its axis, respectively.

The eleventh embodiment will be described below.

In the actual pumping of fuel, the so-called preflow is easily caused and the pressure rising is not sharp. The preflow occurs from the cause that before the opening of an oil passage on the side of the peripheral surface of a plunger is closed completely by a control sleeve, the opening of the oil passage is gradually constricted. This is owing to the circular form of said opening. Fuel is therefore pumped out gradually and as a result, fuel whose pressure does not reach a given injection pressure still is leaked from an injection nozzle V, with disadvantages such as the generation of smoke and the worsening of the ratio of fuel consumption.

This eleventh embodiment has been achieved by paying attentions to the aforementioned facts and its object is to provide a fuel injection pump in which a pumping beginning relief part is connected to the opening of an oil feed port on the plunger periphery, whereby the preflow can be restrained and the pressure rising can be sharpened to prevent the generation of smoke and improve the ratio of fuel consumption.

Figure 53:
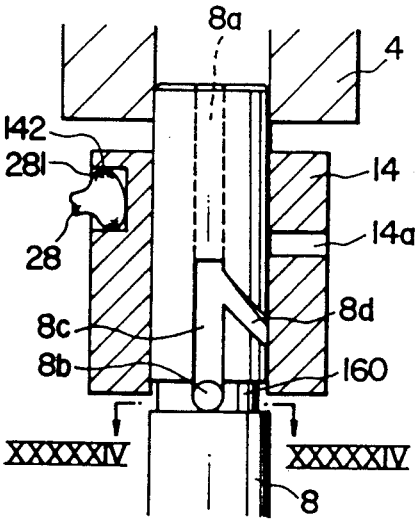
FIG. 53 is a longitudinal sectional view of the main parts of a pump in the eleventh embodiment.
Figure 54:
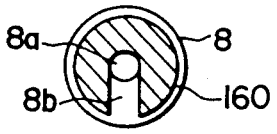
FIG. 54 is a sectional view of FIG. 53 taken along the line XXXXXIV—XXXXXIV and seen from the arrows.

The eleventh embodiment will be now described with reference to FIG. 53 and FIG. 54. This eleventh embodiment is characterized only in the composition of a plunger, but all the other portions are common in composition to these of the aforementioned first to tenth embodiments each and so the description about the common portions will be omitted.

A plunger 8 has an oil passage 8*a* provided therein in which openings opening at its upper end face and at a portion of its peripheral surface are communicated with each other. An inclined groove 8*d* provided bent on the peripheral surface of the plunger 8 is communicated to the opening 8*b* of this oil passage 8*a* on the side of the peripheral surface of the plunger 8. A pumping beginning relief part 160 is further communicated to the opening 8*b* of the oil passage 8*a* on the side of the plunger periphery. This pumping beginning relief part 160 is a groove provided along the peripheral surface of the plunger 8, as shown in FIGS. 53 and 54, and the size of its width is required to be at least equal to or larger than the opening 8*b* of the oil passage 8*a*. In addition, the lower edge of the pumping beginning relief part 160 must be equal to or smaller than the lower edge of said opening.

When the opening 8*b* of the oil passage 8*a* on the side of the peripheral surface of the plunger 8 is thus positioned below the lower end face of a control sleeve 14, fuel is permitted to enter from there into a barrel 4. The plunger 8 rises and passes the lower end face of the control sleeve 14 from the upper end of said opening 8*b*. At the same time, the pumping beginning relief part 160 confronts the lower end face of the control sleeve 14, and the introduction of fuel continues because the effective area of the oil passage 8*a* is not reduced. The pressure of the fuel in the barrel 4 does not reach a given pressure and its pumping into the injection nozzle V is not started until the lower edge of the opening 8*b* passes the lower end face of the control sleeve 14 and the lower edge of the pumping beginning relief part 160 also passes the lower end face of the control sleeve 14. Since the pumping beginning relief part 160 and the opening 8*b* are communicated with each other, namely, the pumping motion is carried out by the complete closing of the pumping beginning relief part 160. In other words, the effective area of the opening 8*b* of the oil passage 8*a* is expanded by the pumping beginning relief part 160, and when the lower edge of the pumping beginning relief part 160 positions above from the lower end face of the control sleeve 14, this effective area becomes zero at a stroke. Accordingly, the preflow quantity of fuel can be reduced and the pressure rising can be sharpened, with no time required for increasing the injection pressure.

Figure 57:
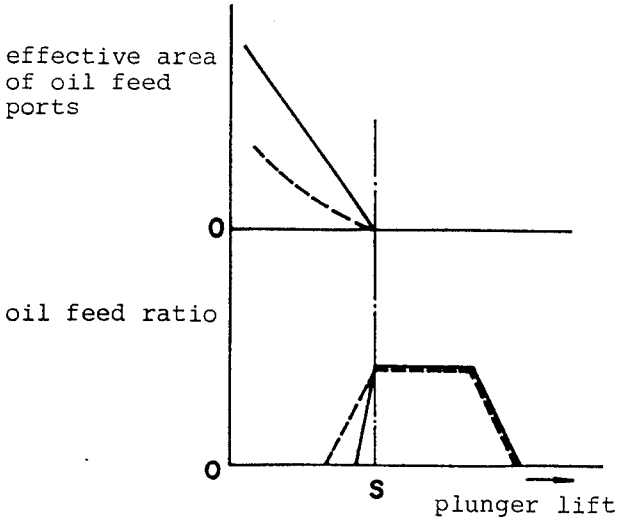
FIG. 57 is a pump characteristic diagram.

In FIG. 57, the solid line represents the pump characteristic resulted from the structure of the aforementioned eleventh embodiment and the dotted line represents that of a conventional structure, respectively. The designation S in the drawing represents a prestroke position. The pump characteristic curve in the aforementioned embodiment until the effective area of the oil passage 8*a* becomes zero is sharp, but that of the conventional structure is gentle. As to the oil feed ratio of fuel, therefore, its rise leading to a given ratio is sharp in the aforementioned embodiment and mild in the conventional structure.

Figure 55:
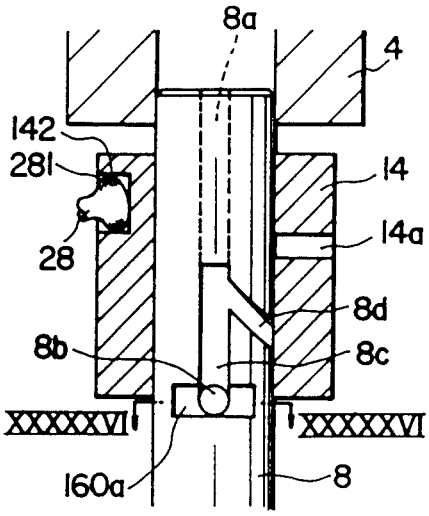
FIG. 55 is a longitudinal sectional view of another modification of the eleventh embodiment similarly to FIG. 53.
Figure 56:
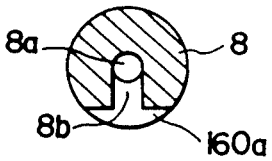
FIG. 56 is a sectional view of FIG. 55 taken along the line XXXXXVI—XXXXXVI and seen from the arrows.

FIG. 55 and FIG. 56 show another modification of this embodiment. The modification is the same as the aforementioned embodiment in such a point that the oil passage 8*a* and inclined groove 8*d* are provided in the plunger 8, but it is composed so that a pumping beginning relief part 160*a* is cut flat on the peripheral surface of a plunger 8. It is a matter of course that this pumping beginning relief part 160*a* is communicated with the opening 8*b* of the oil passage 8*a* and its width in the vertical direction is required to be at least equal to or larger than the opening. The lower edge of the pumping beginning relief part 160*a* must be equal to or smaller than the lower edge of the opening 8*b*. Thus, the pumping beginning relief part 160*a* can obtain the quite same operational effects as the aforementioned embodiment.

The control of the control sleeve 14 in the aforementioned embodiment has been based on the system of the second embodiment shown in FIG. 26, but it may be based on an alternative system.

According to this embodiment which has been described in the above, the pumping beginning relief part provided on the peripheral surface of the plunger is communicated with the oil passage opening provided on the peripheral surface of the plunger, and this pumping beginning relief part can therefore serves to reduce the preflow quantity of fuel and to prevent the generation of smoke and improve the rate of fuel consumption. Furthermore, a fuel injection pump can be therefore provided which is relatively simple in structure, with no bad influence upon the cost.

Figure 58:
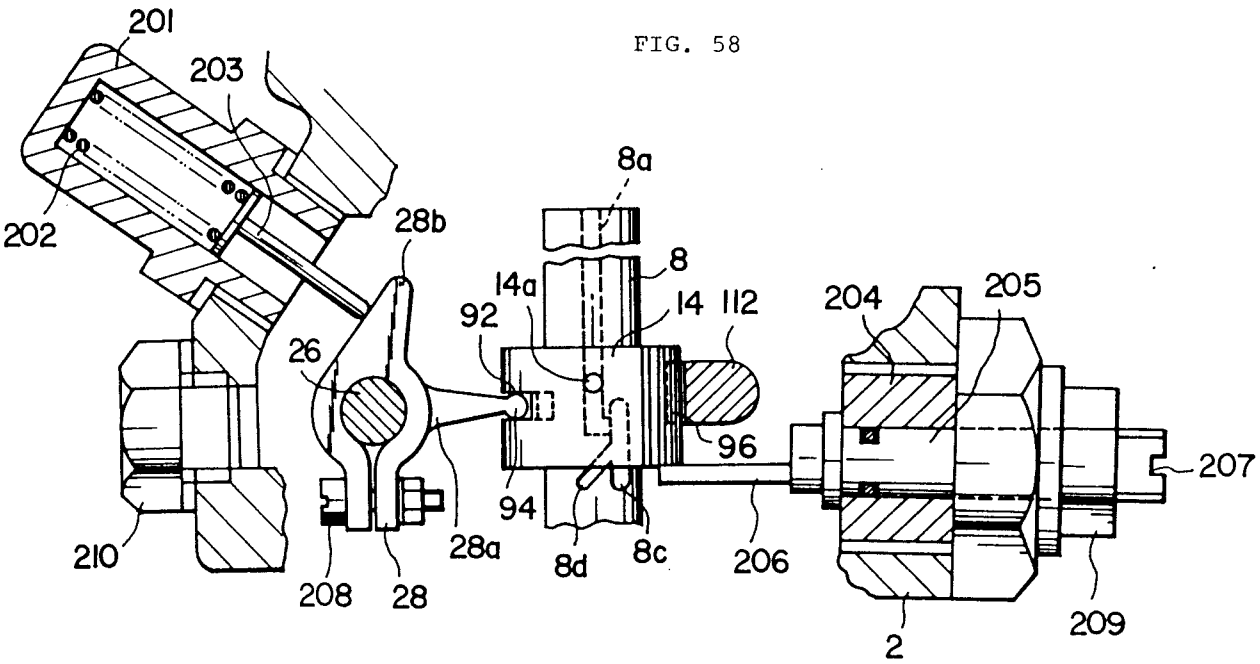
FIG. 58 is a sectional view of the main parts of a pump in the twelfth embodiment.

The twelfth embodiment shown in FIG. 58 is a modification of the eighth embodiment shown in FIG. 42 to FIG. 45, wherein a regulation member 28 with an arm 28*a* protruded therefrom has a sloping surface 28*b* protruded outward in the radial direction, and a press rod 203 is contacted under pressure with said sloping surface 28*b* by means of a spring 202 in a spring case 201 detachably screw-engaged on a housing 2. The reference numeral 204 represents a hollow plug detachably screwed on the housing 2 in access to said rack rod 112; and 205 represents a settling shaft rotatably and oil-tightly inserted in said hollow plug, wherein an eccentric pin 206 which contacts with the lower end face of said control sleeve 14 is provided on the inward end of the settling shaft in the housing, and a groove 207 to which a tool such as a screw driver is to be fitted is provided on the outward end thereof from the housing.

In the abovementioned fuel injection pump device, it is required to match the fuel injection timings of the injection pump for a plurality of cylinders uniformly after its manufacture and assemblage are completed, but before it is fixed on an actual engine. The settling of the injection timings will be carried out as follows:

(1) The spring case 201 is at first screw-engaged to the housing 2, with a fixing bolt or screw 208 of the injection timing regulation member 28 relaxed, and the fore end of the press rod 203 is elastically engaged to the sloping surface 28*b* of said regulation member 28.

(2) In the housing 2, on the other hand, the hollow plug 204 is screw-engaged and the eccentric pin 206 of the settling shaft 205 rotatably supported in the plug is kept contacted with the lower end face of the control sleeve 14. Under that state, the regulation member 28 is biased clockwise in FIG. 58 by way of the press rod 203, by virtue of the force of the spring 202, and as a result, the control sleeve 14 is elastically contacted under pressure to the eccentric pin 206 by way of the arm 28*a* and its spherical part 94, with no play caused.

(3) The injection starting time of the fuel injection pump for each cylinder is then measured, while the cam shaft 12*a* is driven. To the injection pump whose injection starting time is out of a standard, a tool such as a screw driver is applied to the groove 207 of the settling shaft 205 to rotate the settling shaft 205 so that the control sleeve 14 is caused to displace in the axial direction of the plunger 8 by virtue of the eccentric rotation of the eccentric pin 206 and the injection starting time is settled at a reference value, and then a lock nut 209 is tightened to fix the settling shaft 205. In the same way, the fuel injection timings of the injection pump for all the cylinders are set so as to be matched uniformly.

(4) Thereafter, a blind plug 210 for the working hole provided adjacent to the spring case 201 is removed and the bolt or screw 208 is tightened to fix the injection timing regulation member 28 on the control shaft 26. As a result, the fuel injection timings of the injection pump for all the cylinders are matched uniformly.

(5) After completion of the aforementioned work, the spring case 201 and hollow plug 204 are taken out of the housing 2, and the blind plugs are screw-engaged into the screw holes of the housing 2, and all the fuel injection timing-settling work is thus completed.

According to the aforementioned working process, it is advantageously possible, in the case of the fuel injection pump for a multi-cylinder engine, to regulate finely the fuel injection timings for every cylinder and to match and settle them accurately, quickly and easily.

Although a temporary settling means for finely displacing the control sleeve 14 in the axial direction of the plunger 8 has been made up of the settling shaft 205 having the eccentric pin 206 which cooperates with the lower end face of the control sleeve 14 in the aforementioned embodiment, it may be composed that a rack tooth profile having threads in the lateral direction is cut in a plane crossing the control port 14*a*, on the outer peripheral surface of the control sleeve 14 which does not interfere with the rack rod 112 and the regulation member 28, and a settling shaft with a pinion meshing with the rack teeth is rotatably supported on the housing 2, similarly to said settling shaft 205 with the eccentric pin 206, wherein the settling shaft is rotated from the outside of the housing in the same way, thereby to regulate finely the relative position of the control sleeve 14 and plunger 8 in the vertical direction by way of the pinion and rack teeth.

Figure 59:
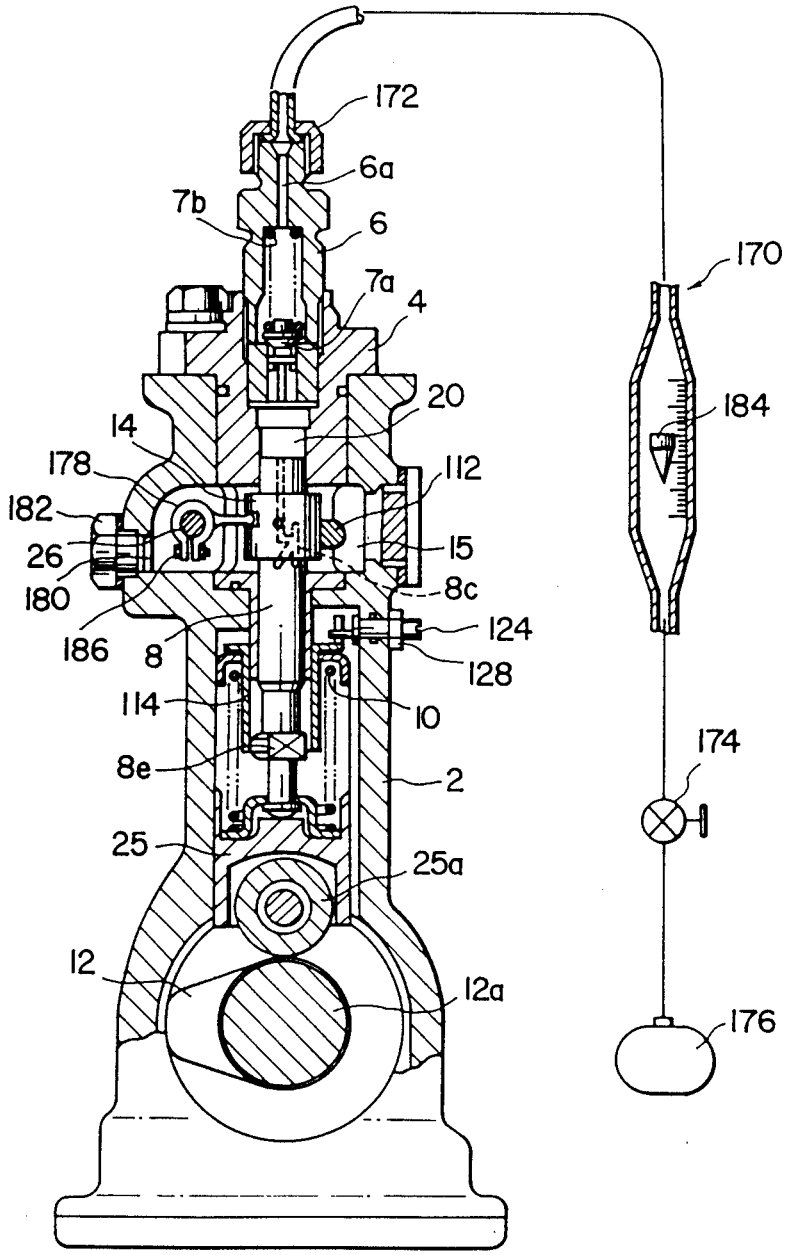
FIG. 59 is a sectional view of a pump in the thirteenth embodiment according to the invention.

The thirteenth embodiment shown in FIG. 59 is a modification of the eighth embodiment shown in FIG. 42 to FIG. 45, which represents a method for carrying out the settling of injection timings, because it is required, after completion of the manufacture and assemblage of the fuel injection pump described in the eighth embodiment, to match the fuel injection timings of this injection pump for a plurality of cylinders uniformly before its mounting onto an actual engine.

(1) After the delivery valve holder 6 is first taken off and the delivery valve 7*a* and spring 7*b* are removed, the delivery valve holder is attached to the barrel 4 again. An air manometer 170 is then connected to the open end of the delivery passage 6*a* by a fitting 172. The air manometer 170 is connected to a proper compressed air source 176 by way of a pressure reducing valve 174.

(2) On the other hand, a sealing plug 182 screw-engaged with a regulating opening 180 opened on the wall portion of the housing 2 which confronts said injection timing control member 178 is removed to open the opening 180.

(3) When the pressure reducing valve 174 is opened in the aforementioned state, the compressed air which has been regulated in pressure is permitted to pass through the air manometer 170 and flow into the fuel chamber 15 through the delivery passage 6*a*, the pressurizing chamber 20, the oil passage 8*a* and the control groove comprising the longitudinal groove 8*c* and inclined groove 8*d*, and further flow out to the atmosphere. (At that time, the control sleeve 14 shall be at the position shown in FIG. 42, FIG. 43 and FIG. 44.) In this case, the indicator 184 of the air manometer 170 is in a floating position as shown in the drawing owing to the air flow.

Figure 43:
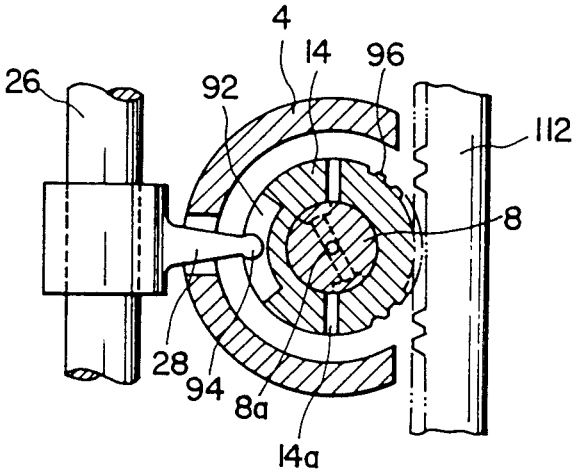
FIG. 43 is a sectional view of FIG. 43 taken along the line XXXXIII—XXXXIII and seen from the arrows.
Figure 44:
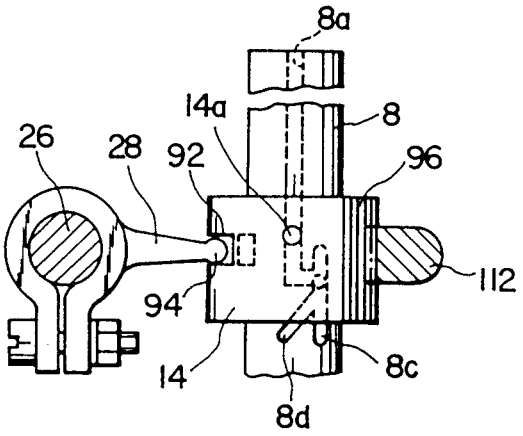
FIG. 44 is a side view of FIG. 43.
Figure 45:
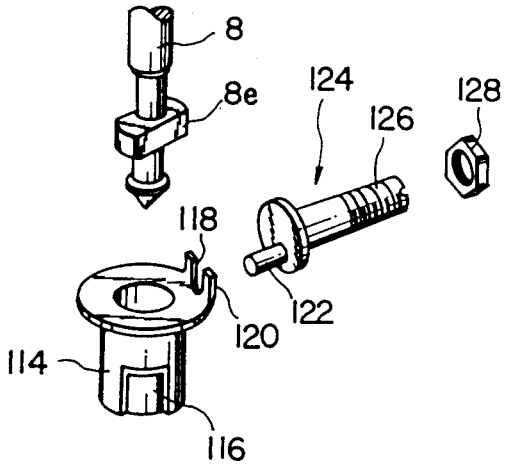
FIG. 45 is an exploded perspective view of the injection quantity regulation member of the injection pump shown in FIG. 42.
Figure 46:
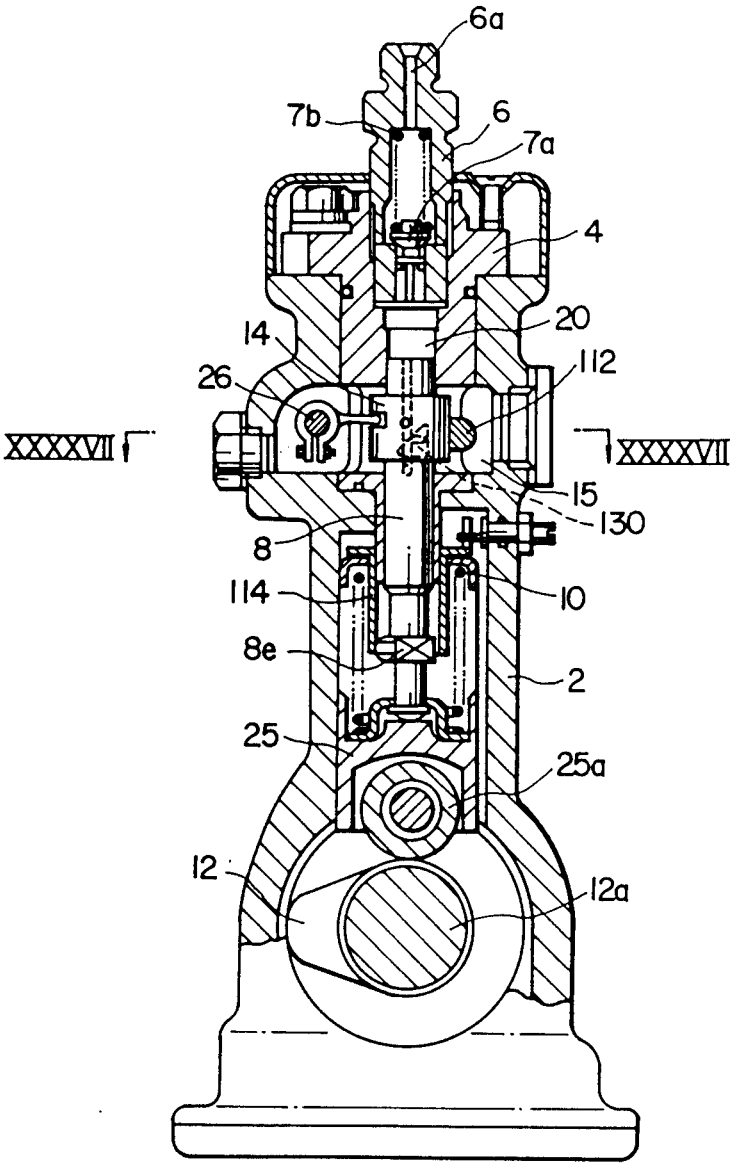
FIG. 46 is a sectional view of a pump in the ninth embodiment.
Figure 47:
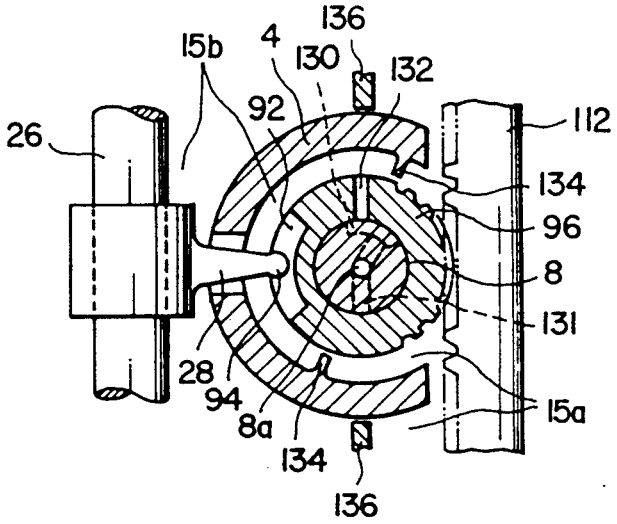
FIG. 47 is a sectional view of FIG. 46 taken along the line XXXXVII—XXXXVII and seen from the arrows.
Figure 48:
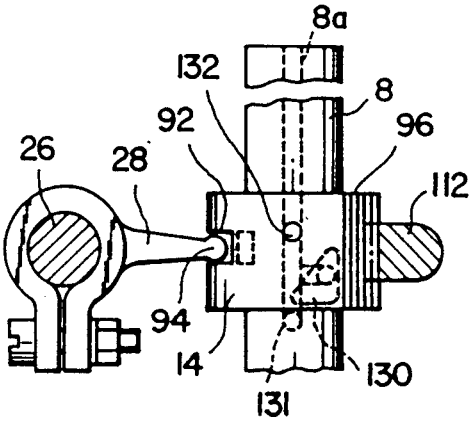
FIG. 48 is a side view of FIG. 47, FIGS. 49(A) to 48(E) illustrate a developmental view showing the fuel injection mode of the pump shown in FIG. 46.
Figure 49:
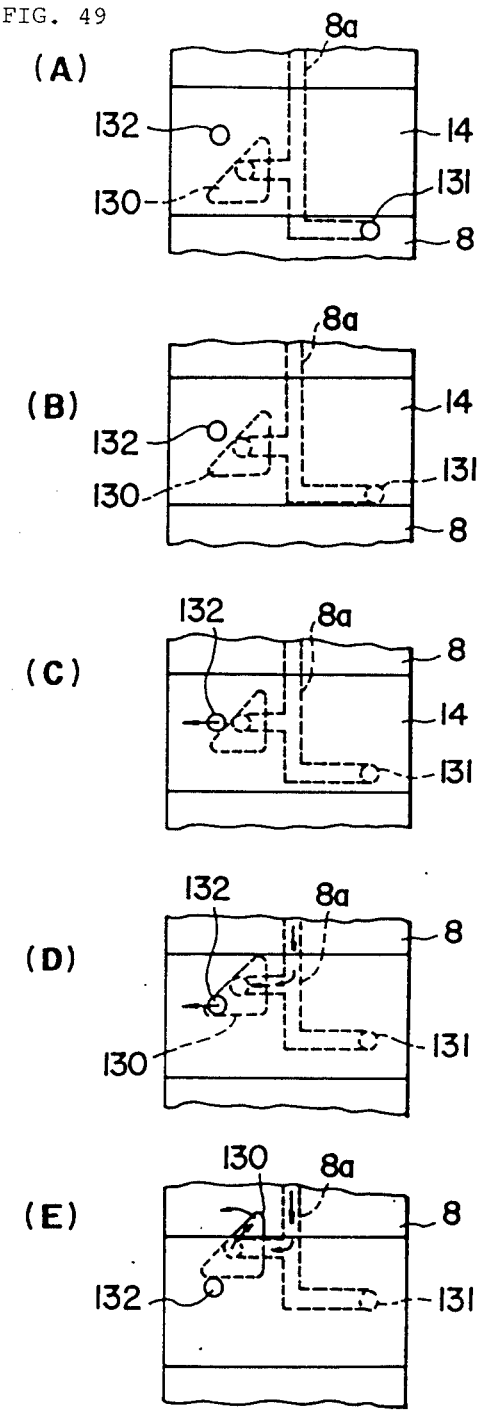

(4) Then, a proper tool is inserted from the regulating opening 180 to turn the arm 28 of the injection timing control member 178 little by little clockwise in FIG. 43 and FIG. 44, so that the control sleeve 14 is moved down with respect to the plunger 8. At the moment when the control sleeve 14 falls and covers the lower edge of the longitudinal groove 8*c* of the control groove, the compressed air flow is stopped. The stoppage of this air flow can be exactly confirmed by the fall of the indicator 184 of the air manometer 170. This position is nothing less than an injection starting position. So, at this position, the control member 178 is fixed on the control shaft 26 by tightening the bolt or screw 186.

It can be therefore practiced very simply and quickly to settle the injection timing of the injection pump for each cylinder with respect to a crank angular position properly set (this is a position in the axial direction of the cam 12 or the plunger 8 therefore). According to this method, a period of time required for settling the injection timing can be obviously shortened less than one of fractions and the cost can be reduced correspondingly, as compared with a conventional method which comprises checking the fuel injection pump by passing fuel therein, and then taking off the sealing plug 182, carrying out the fine adjustment of the injection timing control member 178, and passing the fuel through the injection pump again, and repeating these works several times. Another method may be utilized in which the control groove is first blocked up by the control sleeve 14, reversely to the abovementioned method, and the control sleeve 14 is caused to rise gradually so that the lower end of the control groove is opened by the lower edge of said sleeve, and the moment when the compressed air begins to flow is confirmed by the floating-up of the float 184 of the air manometer 170. The aforementioned embodiment has been applied to the injection pump in which the control groove is provided on the plunger 8 and the control ports 14*a* cooperating therewith are provided on the control sleeve 14, and it can be also applied to an injection pump composed so that a control groove inclined with respect to the plunger axis is provided on the side of the control sleeve 14 and control ports communicated with the oil passage 8*a* are opened on the outer peripheral surface of the plunger 8. In order to match the fuel injection quantities of the injection pump for a plurality of cylinders uniformly, furthermore, the lock nut 128 is relaxed and the regulation member 124 is turned by use of a tool such as a screw driver. Then, the plunger guide 114 is caused to turn together with the plunger 8 around its axis by virtue of the cooperation of the eccentric pin 122 and the engagement groove 118 so that the relative related position of the plunger to the control sleeve 14 is varied, and in other words, the relative position of the control port 14*a* to the control groove is changed. Thus, the fuel injection quantities of the injection pump for the respective cylinders are finely regulated.

After the settling of the injection timings is completed in the abovementioned way, the sealing plug 182 is screw-engaged, the air manometer 170 is taken off and the delivery valve *7a* and spring *7b* are set again to fix the delivery valve holder 6 at the given position, and on the other hand, the lock nut 128 is tightened to obstruct the turning of the plunger 8 around its axis. Thus, all the works are completed.

Although the air manometer has been used in the aforementioned embodiment, the same operational effects as the aforementioned embodiment can be obtained by use of an air flow meter or pressure gauge as a substitute for the air manometer.

We claim:

1. A fuel injection pump device which comprises: a delivery valve communicated with a pressurizing chamber formed in a housing, loaded by a spring and communicated with a fuel injection nozzle; a plunger with its one end facing the pressurizing chamber and the other end operatively connected with a cam which is driven by an engine; a fuel chamber provided so as to surround the plunger in the housing; an oil passage formed in the plunger so that its one end communicates to the pressurizing chamber and the other end communicates to the fuel chamber; a control sleeve slidably mounted on the outer periphery of the plunger in the fuel chamber; a control groove provided on the outer peripheral surface of the plunger for communicating the pressurizing chamber and fuel chamber to each other by way of the oil passages or for interrupting the same, said control groove having at least longitudinally directed edges and inclined edges provided with relation to the axis of the plunger; control ports provided on the control sleeve and communicating the control groove to the fuel chamber when a fuel injection is completed; an injection quantity control member supported on the housing for controlling a fuel injection quantity; an injection timing control member for moving the control sleeve in the axial direction of the plunger; fuel injection control means for controlling the injection quantity control member and the injection timing control member in accordance with signals from operating state information sources, the fuel injection control means is composed so as to advance the injection timing control member on the basis of the information of the engine in a high speed region from the operating state information sources; the control groove is provided on the plunger and the control ports on the control sleeve, respectively, and the length between the upper end of the control sleeve and the control ports is set so as to be equal to or shorter than the length between the upper end of the longitudinally directed edges and the control ports when the plunger is under the state of the minimum effective stroke by virtue of the operation of the injection quantity control member and at the position where it has risen to the top, whereby two-stage blasting of fuel is prevented.

2. A fuel injection pump device, as set forth in claim 1, in which when a geometrical average oil feed ratio $V_p$ (mm$^3$/deg) sought from the diameter D (mm) of the plunger and the lift h (mm) of the cam is given by the related expression $V_p = 2.47 \times 10^{-2} \times D^2 \times h$, the geometrical average oil feed ratio $V_p$ sought from the same related expression $V_p$ is made to exist in such a range that the related expression $22.8\ V_s + 12.8 \geqq V_p \geqq 18.8\ V_s + 10.2$ is satisfied between the geometrical average oil feed ratio $V_p$ and the piston displacement $V_s$ (1) per a single cylinder of the engine.

3. A fuel injection pump device, as set forth in claim 1 or 2, in which the injection quantity control member is composed so as to turn the plunger.

4. A fuel injection pump device, as set forth in claim 1 or 2, in which the injection quantity control member is composed so as to turn the control sleeve around the plunger.

5. A fuel injection pump device, as set forth in claim 1 or 2, in which the oil passage is communicated to the fuel chamber by way of at least two oil feed ports, the control groove is cut on the outer periphery of the plunger so as confront each of the oil passages, and plural control ports are perforated on the control sleeve so as to confront the control grooves.

6. A fuel injection pump device, as set forth in claim 1 or 2, in which the minimum space between both the inclined groove and longitudinal groove in the direction in that the inclined groove intersects the longitudinal groove is made shorter than or equal to the inner diameter of the control ports.

7. A fuel injection pump device, as set forth in claim 1 or 2, in which the inclined groove is formed so as to intersect the portion of the longitudinal groove other than both its ends, and the length of the longitudinal groove in the direction of the plunger axis is set to be shorter than the length of the control sleeve in its sliding direction to constitute a condition for fuel injection and to be larger than the length between the lower end of the control sleeve and the control ports to constitute a condition for no injection of fuel.

8. A fuel injection pump device, as set forth in claim 1 or 2, in which the length between the upper end of the control sleeve and the control ports is set so as to be equal to or shorter than the length of the longitudinal groove when the plunger is displaced with the longitudinal groove and control groove almost according with each other by virtue of the operation of the injection quantity control member, whereby no injection of fuel is obtained.

9. A fuel injection pump device, as set forth in claim 1 or 2, in which a cam profile is formed whose speed constant is almost constant within a given range of the cam angle, in a cam diagram sought by the relation of the angle of the cam and the speed constant of the plunger, and the injection timing control member is controlled within the given range of the cam angle.

10. A fuel injection pump device, as set forth in claim 4, in which the injection quantity control member comprises an operation shaft supported on the housing, an operation lever extended from the operation shaft, whose end is inserted in the hole on the outer periphery surface of the control sleeve, and an injection quantity regulation lever in which the operation shaft is retained for rotation around its axis and which moves the operation shaft in the axial direction, and the injection timing control member comprises an injection timing regulation lever in which the operation shaft is retained for movement in its axial direction and which rotates the operation shaft around its axis.

11. A fuel injection pump device, as set forth in claim 1, in which the fuel injection control means has a hydraulic piston for driving the injection timing control member, a first solenoid valve provided between the fuel delivery side of a fuel system and the oil chamber of the hydraulic piston, a second solenoid valve provided between the oil chamber of the hydraulic piston and the fuel recovery side of the fuel system, a position sensor for detecting the stroke position of the hydraulic piston, and a fuel injection timing control means for controlling the first solenoid valve and the second solenoid valve in accordance with the signals from the position sensor and the signals from the operating state information sources.

12. A fuel injection pump device, as set forth in claim 1, in which the cam has an injection part for injecting fuel from the fuel injection nozzle and an auxiliary part for raising the pressure ranging from the pressurizing chamber to the fuel chamber once after completion of the injection of the fuel.

13. A fuel injection pump device, as set forth in claim 4, in which the injection quantity control member comprises a rack member meshing with a gear formed on the outer periphery of the control sleeve, a screw shaft which is screw-engaged with the rack member, and a fixing means such as a lock nut for fixing the rack member on the screw shaft adjustably.

14. A fuel injection pump device, a set forth in claim 4, in which the delivery valve is attached in a barrel fixed in the housing by clamping bolts, and the plunger is mounted in the barrel so as to be slidable in the direction of its axis, but not relatively rotated around the axis, wherein the regulation of the fuel injection quantity can be carried out by turning the barrel and the plunger as one body around the plunger axis with respect to the control sleeve.

15. A fuel injection pump device, as set forth in claim 4, in which the delivery valve is attached in a barrel fixed in the housing by clamping bolts, the plunger is mounted in the barrel so as to be slidable in the direction of its axis, but not relatively rotated around the axis, a plunger guide is mounted near on the lower end of the plunger so that its relative rotation with the plunger is inhibited around the plunger axis, but its relative displacement is enabled in the direction of the plunger axis, and a regulation member is rotatably supported in the housing, with its one end cooperating with the engagement groove of the plunger guide to tune the plunger guide around the plunger axis, wherein the regulation of the fuel injection quantity can be carried out by turning the regulation member to turn the plunger around the plunger axis with respect to the control sleeve by way of the plunger guide, and then the regulation member can be fixed.

16. A fuel injection pump device, as set forth in claim 1, in which the oil passage has oil feed ports formed at the other end thereof and communicated to or interrupted from the fuel chamber by means of the control sleeve, and the control groove has a first side provided slantedly with respect to the plunger axis and a second side extended in parallel with the plunger axis, in communication with the oil passage on the outer peripheral surface of the plunger, wherein the oil feed ports and the control groove are arranged at an interval around the axis of the plunger.

17. A fuel injection pump device, as set forth in claim 1 or 2, in which one of the injection timing control member and the injection quantity control member is engaged with the control sleeve and the other of the injection timing control member and the injection quantity control member is engaged with said one member so that the operation of said one member is not hindered, wherein the injection timing of fuel is controlled by virtue of the operation of the injection timing control member and the injection quantity of fuel is controlled by virtue of the operation of the injection quantity control member.

18. A fuel injection pump device, as set forth in claim 1, in which the cross-sectional area of the opening of the oil passage to the fuel chamber is made larger than that of the other portion thereof.

* * * * *

UNITED STATES PATENT OFFICE
CERTIFICATE OF CORRECTION

Patent No. 4,754,737 Dated July 5, 1988

Inventor(s) Akio Ishida, Kazuo Itoh, Kimio Uehara

It is certified that error appears in the above-identified patent and that said Letters Patent are hereby corrected as shown below:

Title page:

[73] Mitsubishi Jidosha Kogyo Kabushiki Kaisha, Tokyo, Japan and

Diesel Kiki Co. Ltd., Tokyo, Japan (part interest)

Signed and Sealed this

Twenty-first Day of March, 1989

*Attest:*

DONALD J. QUIGG

*Attesting Officer*

*Commissioner of Patents and Trademarks*